US010814160B2

(12) United States Patent
Liao et al.

(10) Patent No.: US 10,814,160 B2
(45) **Date of Patent: *Oct. 27, 2020**

(54) STATIONARY EXERCISE APPARATUS

(71) Applicants: Hung-Mao Liao, Taichung (TW); Joe Chen, Taichung (TW)

(72) Inventors: Hung-Mao Liao, Taichung (TW); Joe Chen, Taichung (TW)

(73) Assignee: Johnson Health Tech. Co., Ltd., Taichung (TW)

( * ) Notice: Subject to any disclaimer, the term of this patent is extended or adjusted under 35 U.S.C. 154(b) by 54 days.

This patent is subject to a terminal disclaimer.

(21) Appl. No.: 16/104,944

(22) Filed: Aug. 19, 2018

(65) Prior Publication Data

US 2019/0038929 A1 Feb. 7, 2019

Related U.S. Application Data

(63) Continuation-in-part of application No. 15/095,901, filed on Apr. 11, 2016, now Pat. No. 10,369,403, (Continued)

(30) Foreign Application Priority Data

Nov. 4, 2005 (CN) ..... 2005 1 0115518
Jul. 27, 2006 (CN) ..... 2006 1 0103811

(51) Int. Cl.
*A63B 22/00* (2006.01)
*A63B 24/00* (2006.01)
(Continued)

(52) U.S. Cl.
CPC ..... *A63B 22/001* (2013.01); *A63B 21/225* (2013.01); *A63B 21/4034* (2015.10); (Continued)

(58) Field of Classification Search
CPC ..... A63B 21/00058; A63B 21/00069; A63B 21/00072; A63B 21/22; A63B 21/225; (Continued)

(56) References Cited

U.S. PATENT DOCUMENTS 5,383,829 A * 1/1995 Miller ..... A63B 22/001 482/57
5,540,637 A * 7/1996 Rodgers, Jr. ..... A63B 22/001 482/51

(Continued)

*Primary Examiner* — Gary D Urbiel Goldner

(57) ABSTRACT

A stationary exercise apparatus includes a frame; two moving members respectively coupled to the frame, one end portion of each moving member located to define a swing axis; two swing members, one end portion of each swing member pivotally joined to the swing axis of the moving members; two supporting members respectively connected to the swing members, wherein one end portion of each supporting member is movably coupled to the frame, the other end portion of each supporting member is joined to the respective swing member so that one end portion of each supporting member moves along a reciprocating path; and two pedal sets respectively coupled to the supporting members, the pedal sets moving along a first path while the one end portions of the supporting members are reciprocating along the reciprocating path and the other end portions of the supporting members are rotating about a rotating axis.

12 Claims, 34 Drawing Sheets

Related U.S. Application Data which is a continuation of application No. 13/782,798, filed on Mar. 1, 2013, now Pat. No. 9,339,684, which is a continuation of application No. 13/335,437, filed on Dec. 22, 2011, now Pat. No. 8,403,815, which is a continuation of application No. 12/773,849, filed on May 5, 2010, now Pat. No. 8,092,349, which is a continuation of application No. 11/497,783, filed on Aug. 2, 2006, now Pat. No. 7,722,505, which is a continuation-in-part of application No. 11/434,541, filed on May 15, 2006, now Pat. No. 7,682,290.

(51) Int. Cl.

| | |
|---|---|
| ***A63B 22/04*** | (2006.01) |
| ***A63B 21/22*** | (2006.01) |
| ***A63B 21/00*** | (2006.01) |
| ***A63B 22/06*** | (2006.01) |
| ***A63B 22/20*** | (2006.01) |

(52) U.S. Cl.

CPC ..... *A63B 22/0015* (2013.01); *A63B 22/0023* (2013.01); *A63B 22/0056* (2013.01); *A63B 22/04* (2013.01); *A63B 22/0664* (2013.01); *A63B 22/205* (2013.01); *A63B 24/00* (2013.01); *A63B 2022/0051* (2013.01); *A63B 2022/067* (2013.01); *A63B 2022/0676* (2013.01); *A63B 2022/206* (2013.01); *A63B 2225/09* (2013.01)

(58) Field of Classification Search

CPC ..... A63B 21/4027; A63B 21/4033; A63B 21/4034; A63B 21/4041; A63B 21/4045; A63B 21/4047; A63B 21/4049; A63B 22/0015; A63B 22/0023; A63B 22/0046; A63B 22/0048; A63B 22/0056; A63B 22/04; A63B 22/06; A63B 22/0605; A63B 22/0664; A63B 22/18; A63B 2022/0051; A63B 2022/0611; A63B 2022/0635; A63B 2022/0676; A63B 223/035; A63B 23/03516; A63B 23/03533; A63B 23/04; A63B 23/0405; A63B 23/0429; A63B 23/0476; A63B 23/0482; A63B 23/0494; A63B 2023/0452; A63B 2225/09; A63B 2225/093

See application file for complete search history.

(56) References Cited

U.S. PATENT DOCUMENTS

| | | | | | |
|---|---|---|---|---|---|
| 5,573,480 | A * | 11/1996 | Rodgers, Jr. | A63B 22/001 | 482/51 |
| 5,685,804 | A * | 11/1997 | Whan-Tong | A63B 22/001 | 482/51 |
| 5,788,609 | A * | 8/1998 | Miller | A63B 21/00178 | 482/51 |
| 5,813,949 | A * | 9/1998 | Rodgers, Jr. | A63B 22/001 | 482/51 |
| 5,893,820 | A * | 4/1999 | Maresh | A63B 22/001 | 482/51 |
| 5,910,072 | A * | 6/1999 | Rawls | A63B 21/0053 | 482/51 |
| 5,916,065 | A * | 6/1999 | McBride | A63B 22/001 | 482/51 |
| 5,924,962 | A * | 7/1999 | Rodgers, Jr. | A63B 22/001 | 482/51 |
| 5,938,567 | A * | 8/1999 | Rodgers, Jr. | A63B 22/001 | 482/51 |
| 6,004,244 | A * | 12/1999 | Simonson | A63B 21/153 | 482/51 |
| 6,126,573 | A * | 10/2000 | Eschenbach | A63B 21/015 | 482/51 |
| 6,135,926 | A * | 10/2000 | Lee | A63B 22/001 | 482/51 |
| 6,146,313 | A * | 11/2000 | Whan-Tong | A63B 22/001 | 482/51 |
| 6,168,552 | B1 * | 1/2001 | Eschenbach | A63B 22/001 | 482/51 |
| 6,422,977 | B1 * | 7/2002 | Eschenbach | A63B 22/001 | 482/51 |
| 6,440,042 | B2 * | 8/2002 | Eschenbach | A63B 22/001 | 482/51 |
| 7,169,087 | B2 * | 1/2007 | Ercanbrack | A63B 22/001 | 482/51 |
| 7,278,955 | B2 * | 10/2007 | Giannelli | A63B 22/0056 | 482/51 |
| 7,316,633 | B2 * | 1/2008 | Liao | A63B 22/001 | 482/52 |
| 7,347,806 | B2 * | 3/2008 | Nakano | A63B 24/00 | 434/247 |
| 7,682,290 | B2 * | 3/2010 | Liao | A63B 22/001 | 482/51 |
| 7,691,034 | B2 * | 4/2010 | May | A63B 22/0012 | 482/52 |
| 7,722,505 | B2 * | 5/2010 | Liao | A63B 22/0015 | 482/52 |
| 7,731,634 | B2 * | 6/2010 | Stewart | A63B 22/0007 | 482/52 |
| 7,736,278 | B2 * | 6/2010 | Lull | A63B 21/154 | 482/52 |
| 7,766,797 | B2 * | 8/2010 | Dalebout | A63B 22/001 | 482/51 |
| 7,785,235 | B2 * | 8/2010 | Lull | A63B 22/001 | 482/52 |
| 8,092,349 | B2 * | 1/2012 | Liao | A63B 21/225 | 482/52 |
| 8,403,815 | B2 * | 3/2013 | Liao | A63B 21/225 | 482/52 |
| 9,339,684 | B2 * | 5/2016 | Liao | A63B 22/0023 | |
| 10,369,403 | B2 * | 8/2019 | Liao | A63B 22/001 | |
| 2003/0083177 | A1 * | 5/2003 | Tung | A63B 22/0015 | 482/51 |
| 2004/0209741 | A1 * | 10/2004 | Kuo | A63B 22/001 | 482/52 |
| 2005/0202939 | A1 * | 9/2005 | Lull | A63B 22/001 | 482/57 |
| 2006/0003868 | A1 * | 1/2006 | Lull | A63B 21/154 | 482/52 |
| 2006/0189445 | A1 * | 8/2006 | Stewart | A63B 22/0007 | 482/52 |

* cited by examiner

STATIONARY EXERCISE APPARATUS

CROSS-REFERENCE TO RELATED APPLICATION

This application is a Continuation-in-part of U.S. patent application Ser. No. 15/095,901, filed on Apr. 11, 2016, which is a continuation of U.S. patent application Ser. No. 13/782,798, filed on Mar. 1, 2013, now U.S. Pat. No. 9,339,684, which is a continuation of U.S. patent application Ser. No. 13/335,437, filed on Dec. 22, 2011, now U.S. Pat. No. 8,403,815, which is a continuation of U.S. patent application Ser. No. 12/773,849, filed on May 5, 2010, now U.S. Pat. No. 8,092,349, which is a continuation of U.S. patent application Ser. No. 11/497,783, filed on Aug. 2, 2006, now U.S. Pat. No. 7,722,505, which claims the benefit of Chinese patent application no.: 200610103811.X, filed on Jul. 27, 2006, and is a continuation-in-part of U.S. patent application Ser. No. 11/434,541, filed on May 15, 2006, which issued as U.S. Pat. No. 7,682,290 on Mar. 23, 2010, which claims the benefit of Chinese patent application no.: 200510115518.0, filed Nov. 4, 2005, each of which is incorporated by reference in their entireties.

BACKGROUND

1. Field of the Invention

This present disclosure relates to a stationary exercise apparatus, and more particularly to a leg exercise apparatus.

2. Description of Related Art

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY

A stationary exercise apparatus includes a frame; two moving members respectively coupled to the frame, one end portions of the moving members located to define a swing axis; two swing members, one end portions of the swing members respectively pivotally joined to the swing axis of the moving members; two supporting members respectively connected to the swing members, wherein one end portions of the supporting members are movably coupled to the frame, the other end portions of the supporting members are respectively joined to the swing members so that one end portions of the supporting members moving along a reciprocating path; and two pedal sets respectively coupled to the supporting members, the pedal sets moving along a first path while the one end portions of the supporting members are reciprocating along the reciprocating path and the other end portions of the supporting members are rotating about a rotating axis.

DETAIL DESCRIPTION

Figure 1:
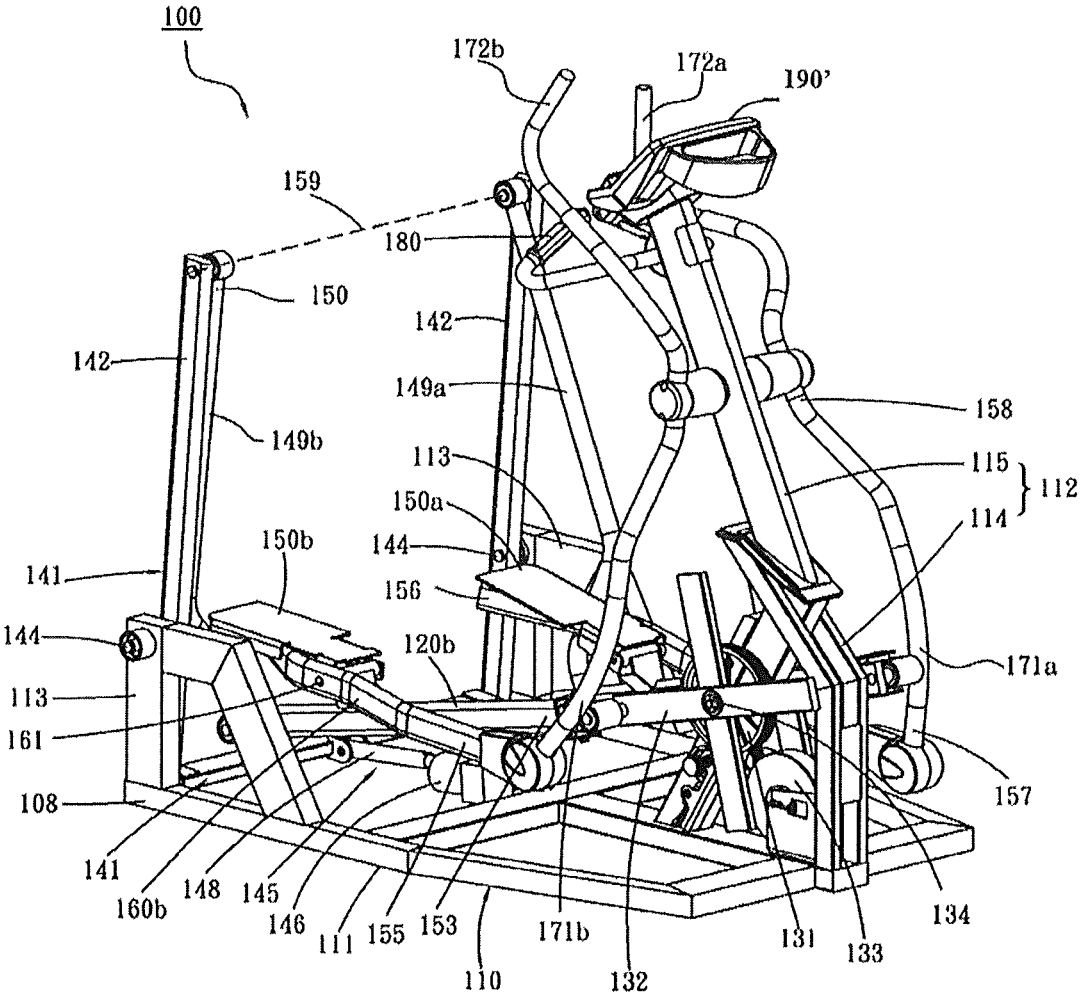
FIG. 1 is a perspective view of a stationary exercise apparatus according to an embodiment of the present disclosure.

Referring now specifically to the figures, in which identical or similar parts are designated by the same reference numerals throughout, a detailed description of the present disclosure is given. It should be understood that the following detailed description relates to the best presently known embodiment of the disclosure. However, the present disclosure can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190' are mounted on or near the upper end of the standard 115. Left and right cranks 132 (FIG. 2) are each pivoted to one portion of the frame 110 defining a first axis 134 and in the illustrated embodiment, the first axis 134 is at or near the front portion of the frame 110. The left and right cranks 132 could be replaced by a pair of disks, flywheels, or other device rotating about the first axis 134. The left and right cranks 132 and the first axis 134 can also be replaced by a pair of closed tracks circulating about a virtual axis, as opposed to an axis defined by a wheel axle. The frame 110 may further comprise a pulley 131 and a resistance member 133 which is controlled by using the console 190' to vary operating resistance for a user.

Figure 2:
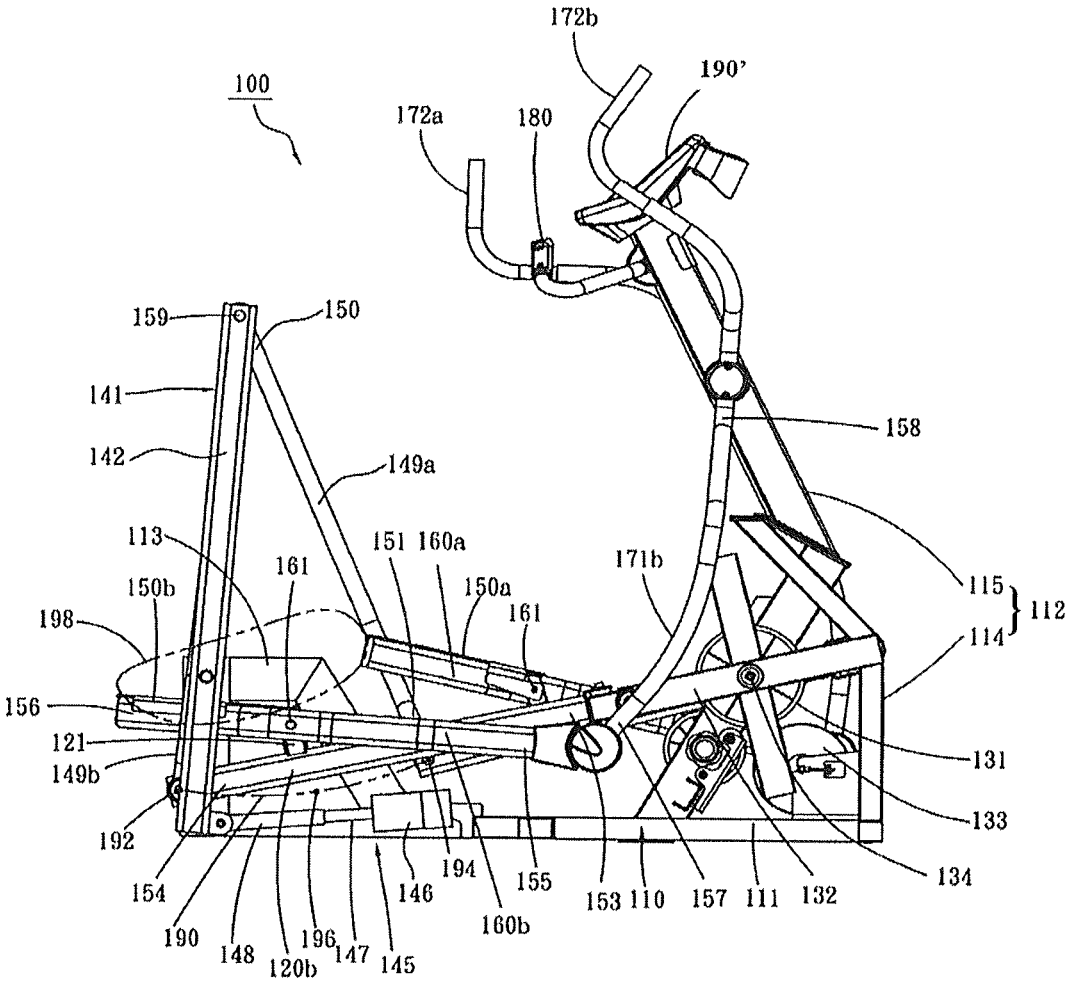
FIG. 2 is a side view of the stationary exercise apparatus of FIG. 1 in a rotating position of a low incline condition.
Figure 3:
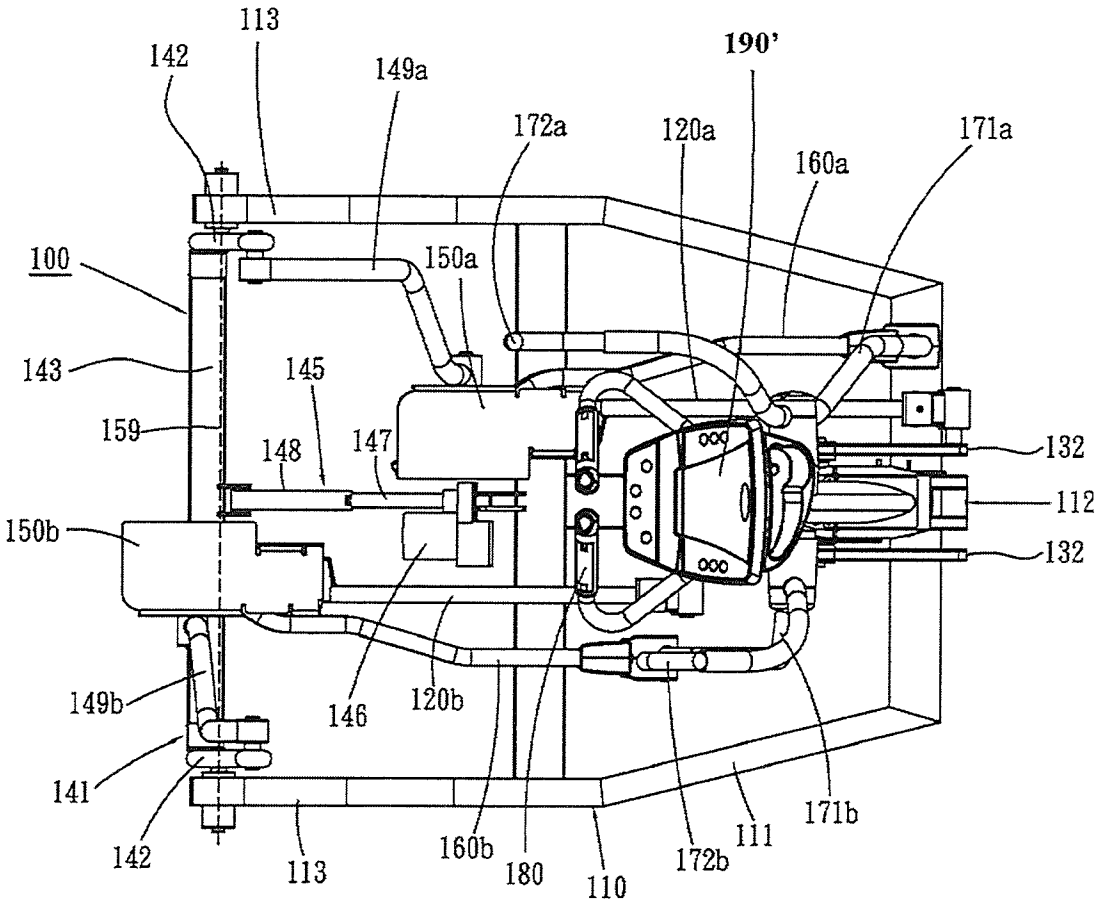
FIG. 3 is a top view of the stationary exercise apparatus of FIG. 1.
Figure 6:
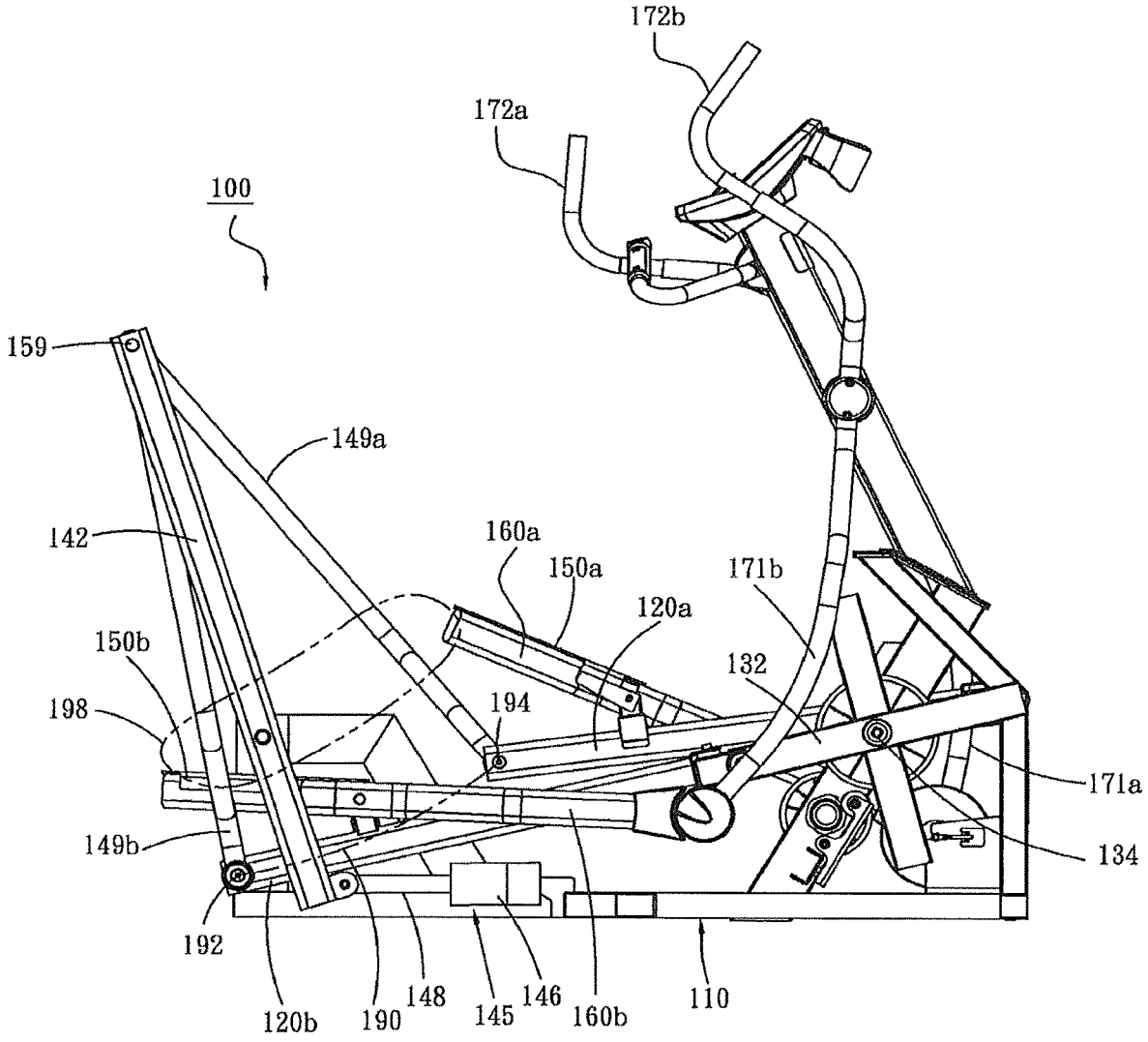
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present disclosure as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 147 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6. Although described and illustrated as a screw adjusting mechanism, the adjusting assembly 145 could be any manual or automatic mechanical, electromechanical, hydraulic, or pneumatic device and be within the scope of the invention. The adjusting assembly 145 is illustrated as being mounted on the right side of the exercise device 100, but both moving members 142 are adjusted because the lateral link 143 (FIG. 4) transfers the force to the left side moving member 143.

Figure 4:
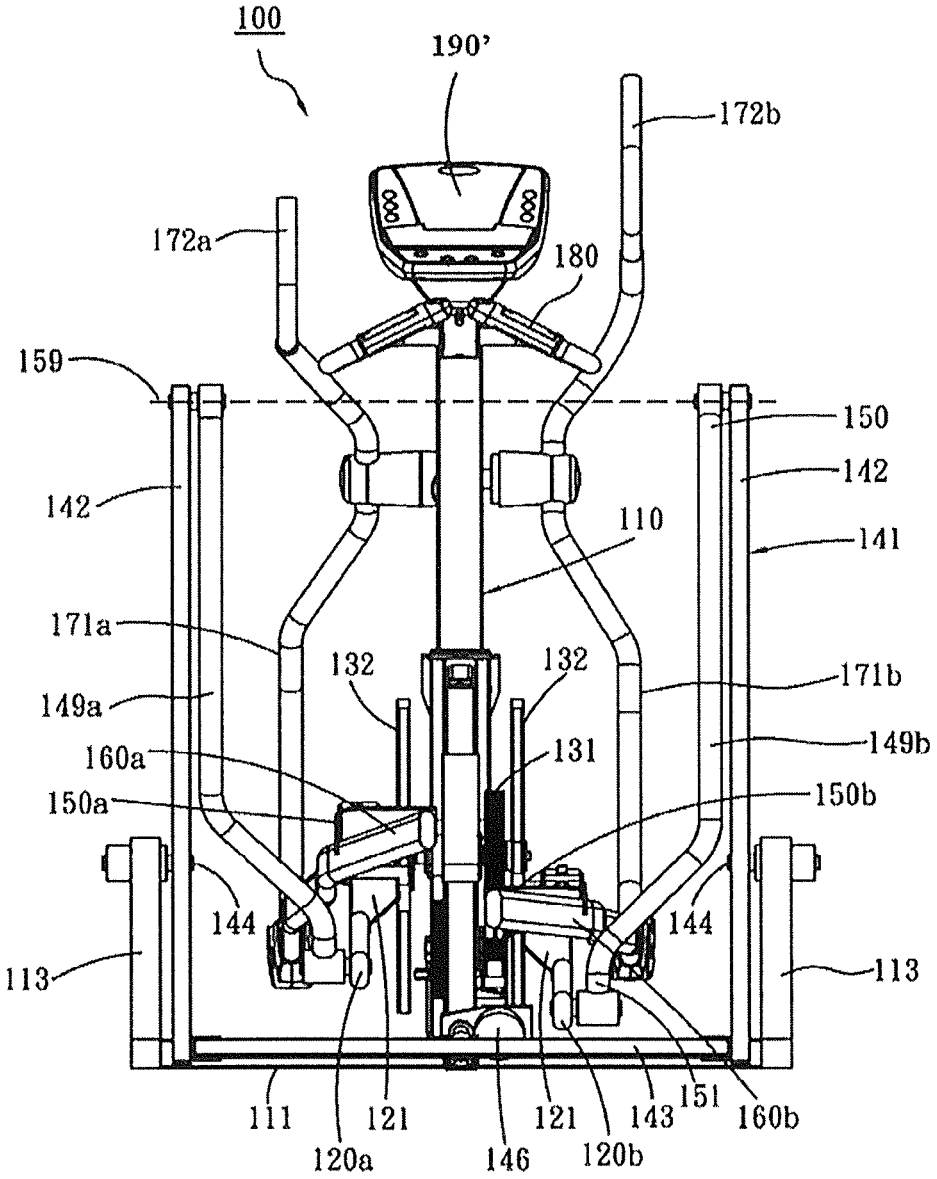
FIG. 4 is a back view of the stationary exercise apparatus of FIG. 1.

Referring to FIGS. 2 and 4, the stationary exercise apparatus 100 comprises first and second swing members **149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame 110. In the embodiment of the present disclosure, the upper portions 150 of the first and second swing members 149*a*/149*b* are respectively pivoted to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100**.

Figure 5:
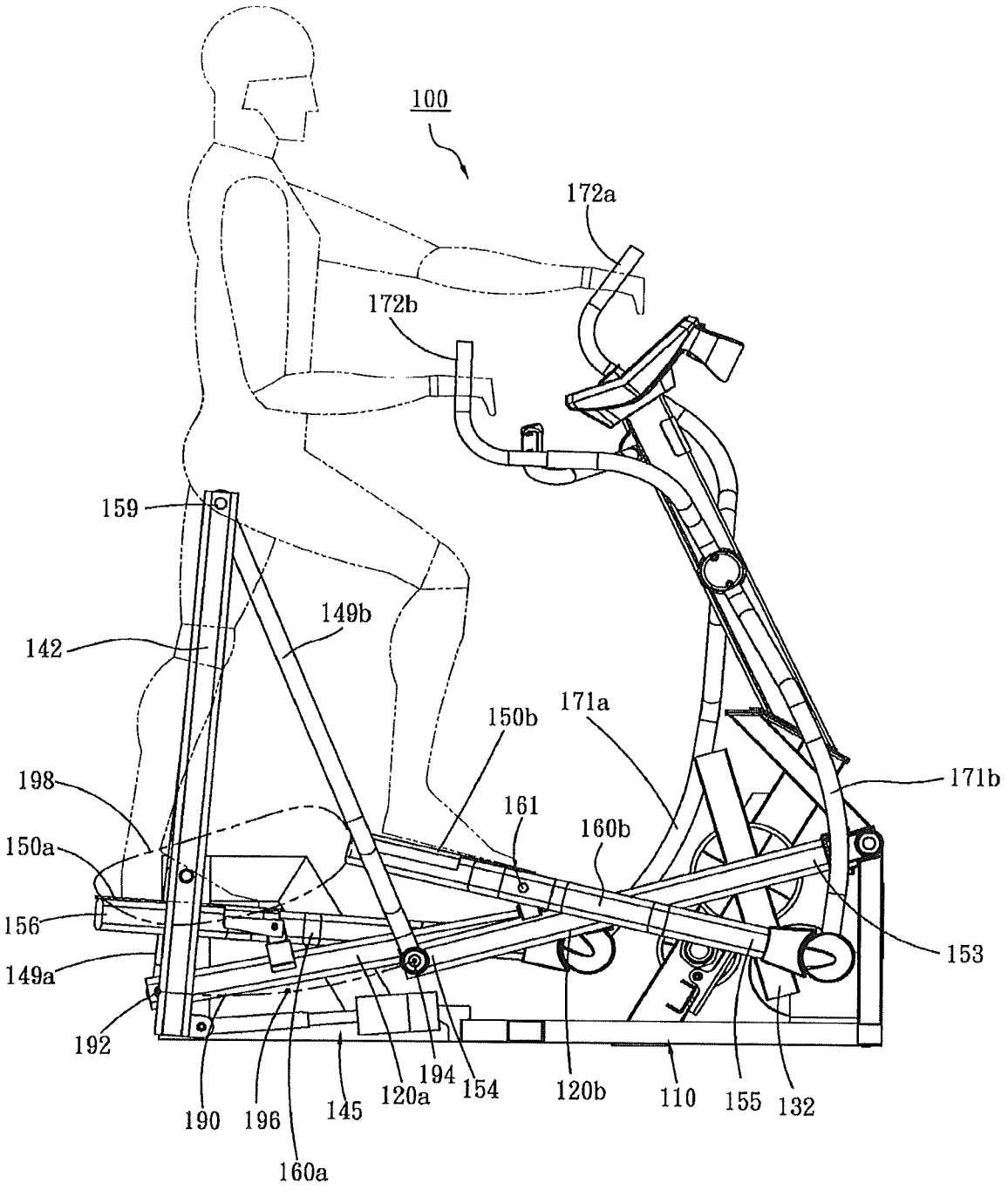
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members **120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the embodiment of the present disclosure, the first end portions 153 of the first and second supporting members 120*a*/120*b* are respectively pivoted to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivoted to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120***a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the embodiment of the present disclosure, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivoted to the first end portions 155 of the first and second control links 160*a*/160*b* and the upper end portions 158 of the first and second handle links 171*a*/171*b* are pivoted to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the embodiment of the present disclosure, the first and second pedals 150*a*/150*b* are indirectly connected to the first and second supporting members 120*a*/120*b*. More specifically, the first and second pedals 150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noticed that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion 154 of the second support member 120*b* is being at the rear end 192 of the reciprocating path 190 while the first end portion 153 of the second supporting member 120*b* is being approximately at the rearmost position during rotating about the first axis 134. As also shown in FIG. 5, the second end portion 154 of the second support member 120*b* is being at the front end 194 of the reciprocating path 190 while the first end portion 153 of the second supporting member 120*b* is being approximately at the foremost position during rotating about the rotating axis 134. In the embodiment of the present disclosure, the reciprocating path 190 is substantially arcuate because of the swing motion of the first and second swing members 149*a*/149*b*, but the present disclosure is not limited to an arcuate reciprocating path. It should be noticed that relative positions between the swing axis 159 and the reciprocating path 190 can cause different exercise intensity of the stationary exercise apparatus 100. As illustrated in FIG. 2, the swing axis 159 is positioned higher than the front end 194.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearward in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In an embodiment of the present disclosure, the adjusting assembly 145 can be controlled via the console 190' to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present disclosure, the incline level of the second closed path 198 could also be non-adjustable. For example, the side portions 113 of the frame 110 extend upwardly and the first and second swing members 149*a*/149*b* are directly pivoted to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level.

To operate the stationary exercise apparatus 100, a user respectively steps on the first and second pedals 150*a*/150*b* and grabs on the fixed handle assembly 180 or a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 8:
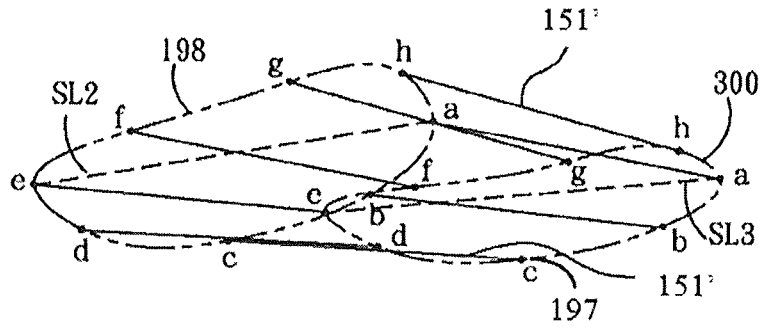
FIG. 8 are toe and heel path profiles of the stationary exercise apparatus of FIG. 1 in a relatively low incline condition.
Figure 9:
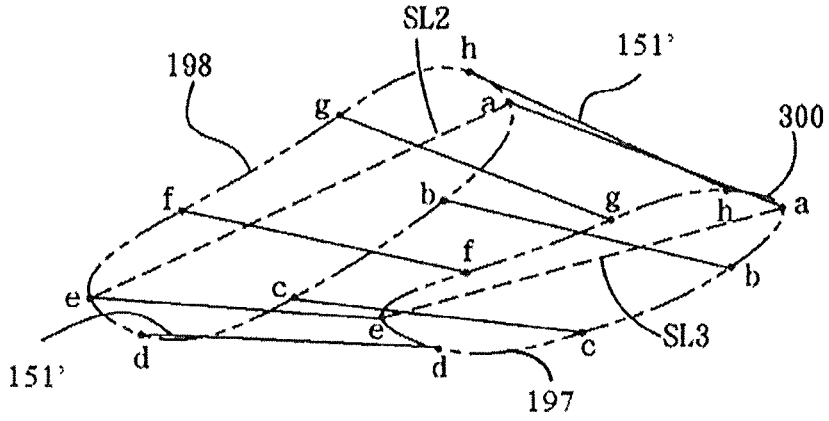
FIG. 9 are toe and heel path profiles of the stationary exercise apparatus of FIG. 1 in a relatively high incline condition.
Figure 10:
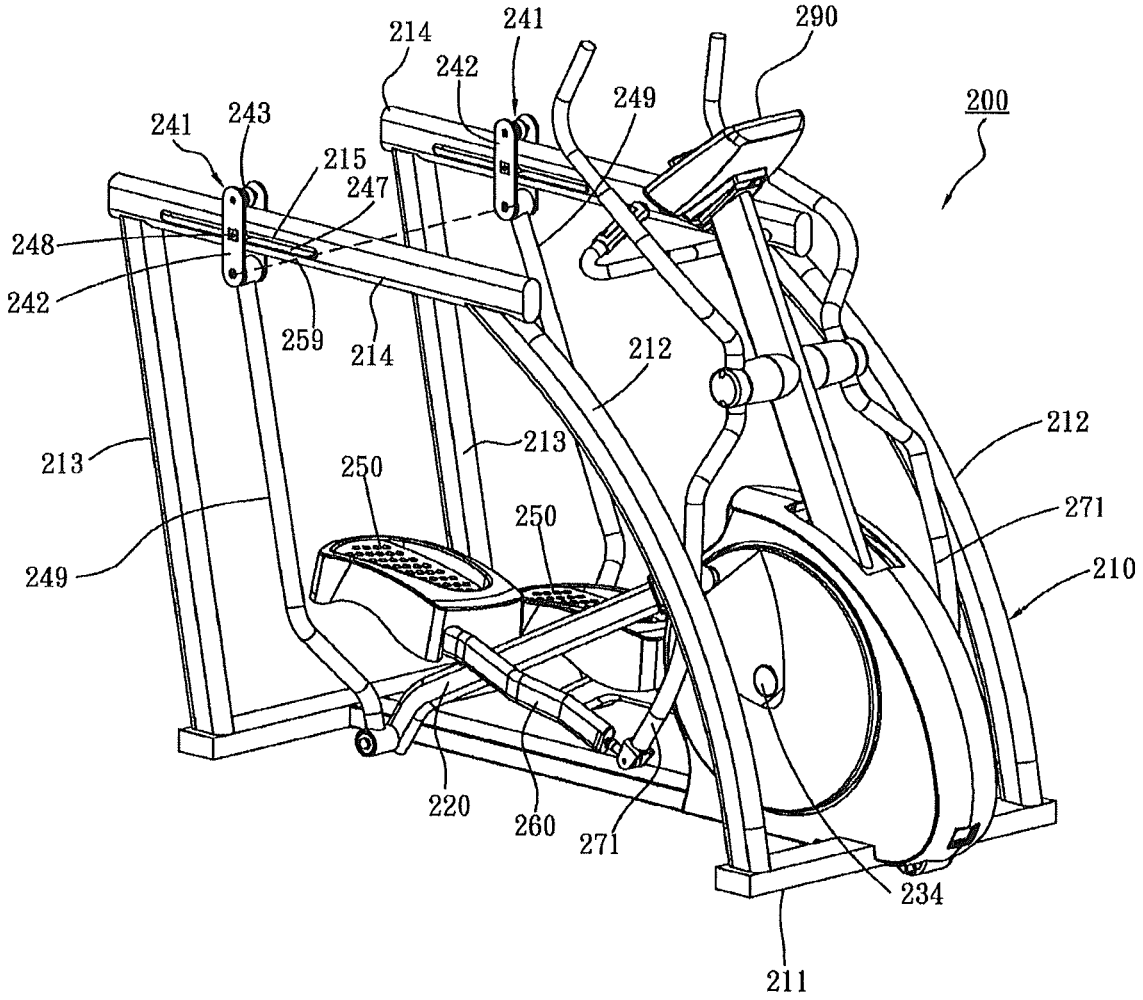
FIG. 10 is a perspective view of a stationary exercise apparatus according to another embodiment of the present disclosure.
Figure 11:
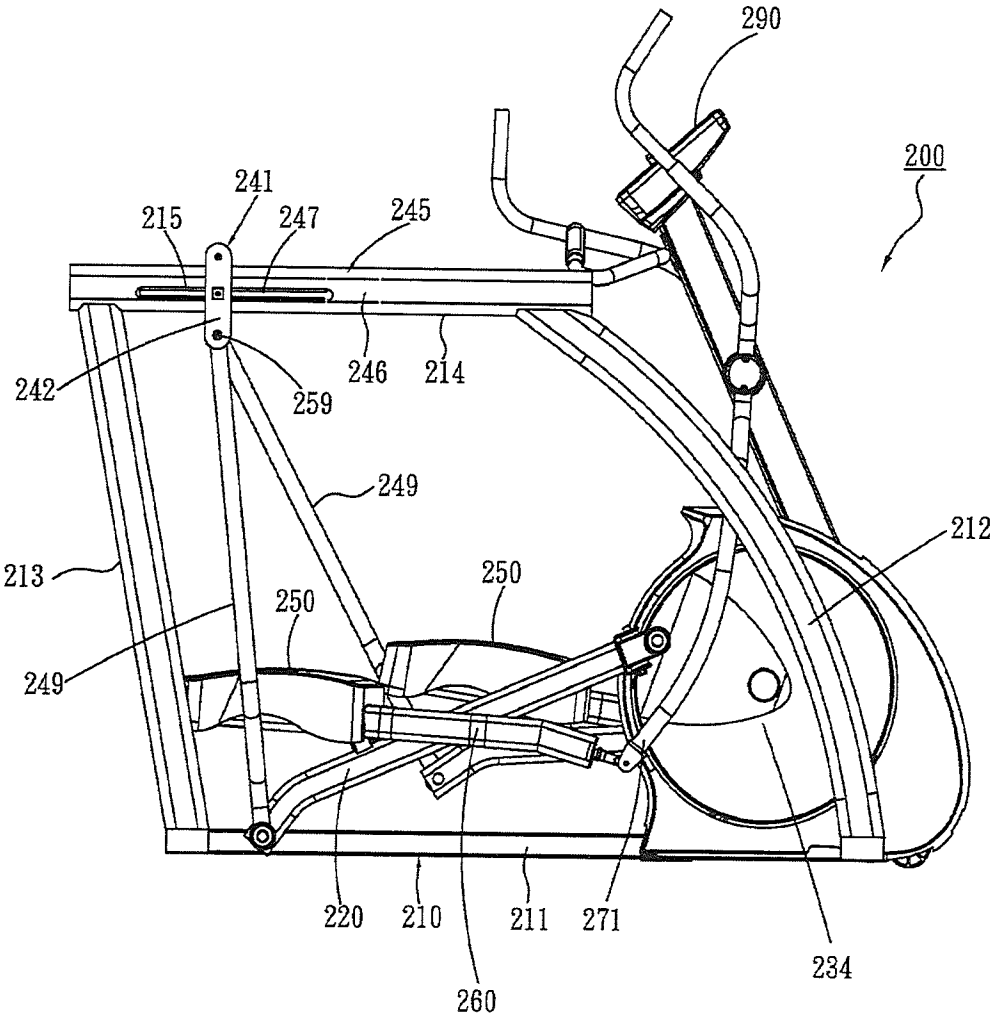
FIG. 11 is a side view of the stationary exercise apparatus of FIG. 10.
Figure 12:
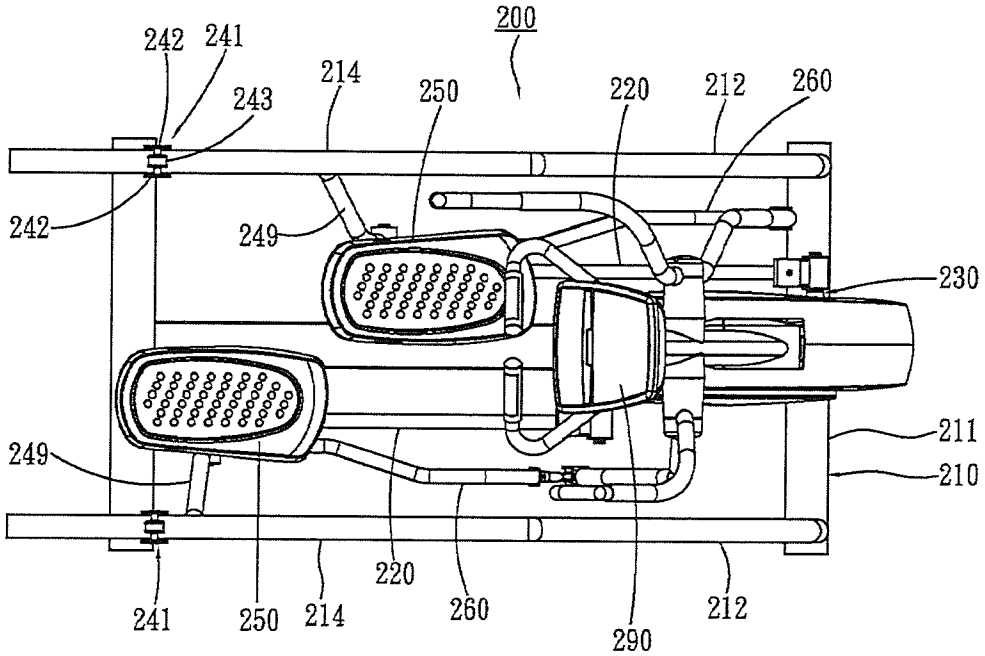
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192.

Now referring to FIG. 8 in more detail, the second closed path 198 is represented by eight correspondent points, a~h. The correspondent points a and e are the foremost and rearmost positions of the first ends of the first and second supporting members 120*a*/120*b* during rotating about the first axis 134. Each point is separated in an equal angle of forty-five degrees relative to the angle of rotation about the first axis 134. A stride length SL2 constituted by the correspondent points a and e is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is approximate to the rear ends of the pedals 150*a*/150*b*. Stride length is also relative to exercise intensity. A longer stride length generally results in higher exercise intensity. A third closed path 197 is the moving path of the front ends of the pedals 150*a*/150*b*. A stride length SL3 may also substantially represent the stride length of the toe portion of a user. Because the closed paths 198 and 197 are moving paths of the rear and front ends of the pedals 150*a*/150*b*, the orientation of the pedals 150*a*/150*b* can be illustrated by a pedal orientation 151' as shown in FIG. 8. One important character of the pedal orientation 151' is that the steepness of the pedal orientation 151' is increased when the swing axis 159 is adjusted backwardly.

Figure 7:
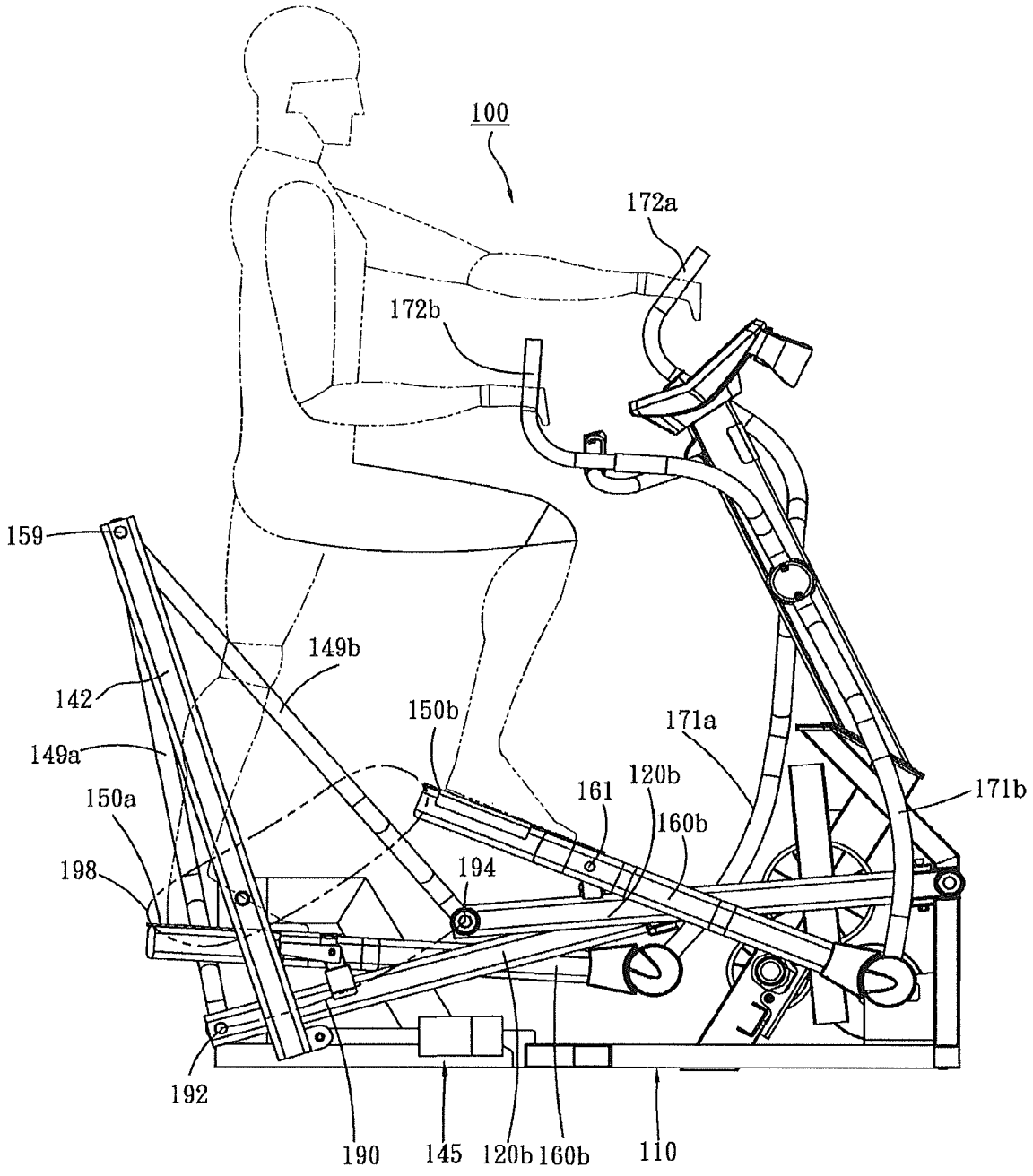
FIG. 7 is a side view of the stationary exercise apparatus of FIG. 1 in another rotating position of the high incline condition demonstrating better gluteus exercise of a user.

Now referring to FIGS. 7 and 9 show the stride length SL2, stride length SL3, pedal orientation 151', second closed path 198, and third closed path 197 while the swing axis 159 is in back of the rear end 192 of the reciprocating path 190. As shown in FIG. 7, the first and second control links 160*a*/160*b* are respectively pivoted to the first and second supporting members 120*a*/120*b* via pivot axes 161. The incline level of the second closed path 198 of FIG. 9 is increased by 17 degrees compared to the incline level of FIG. 8, but the incline level of the third closed path 197 of FIG. 9 is only increased by 11 degrees. That is, the incline level of the second closed path 198 is increased more than the incline level of the third closed path 197 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second embodiment of the present disclosure is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivoted to a pair of rotating members (not shown) in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
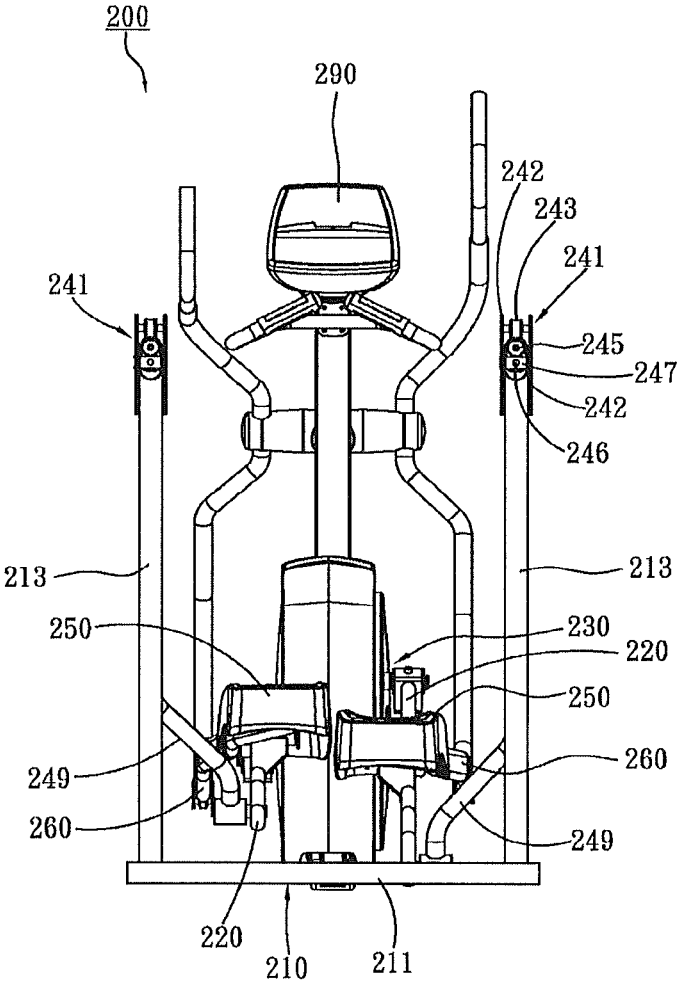
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second embodiment of the present disclosure, the upper portions of the first and second swing members 249 are respectively pivoted to the third and fourth moving members 242. But, the upper portions of the first and second swing members 249 can also be directly pivoted to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivoted to the supporting members 220 and a pair of handle links 271 coupled to the frame 210 for guiding the control links 260.

Figure 14:
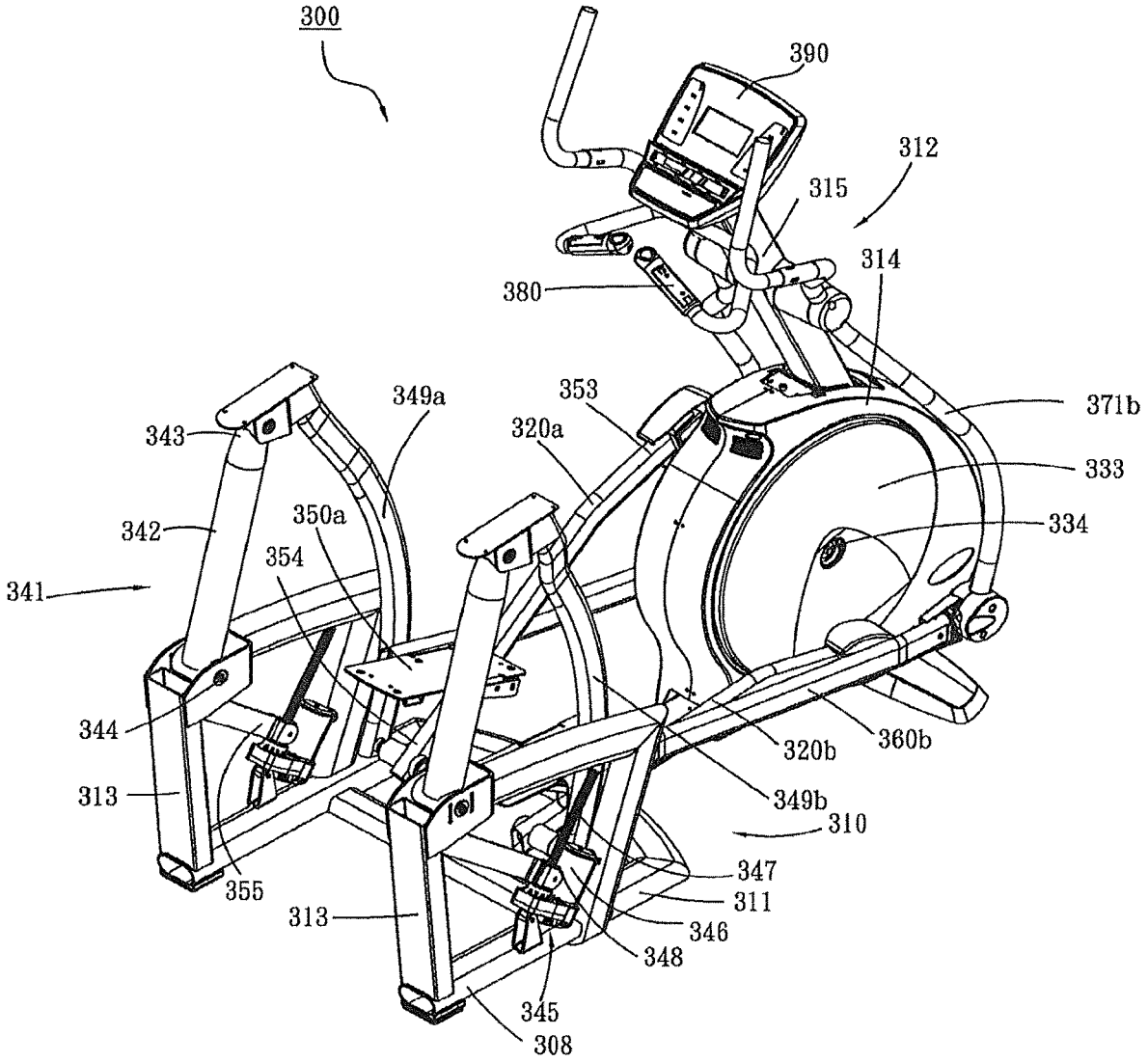
FIG. 14 is a perspective view of a third embodiment of a stationary exercise device in accordance with the present disclosure.
Figure 15:
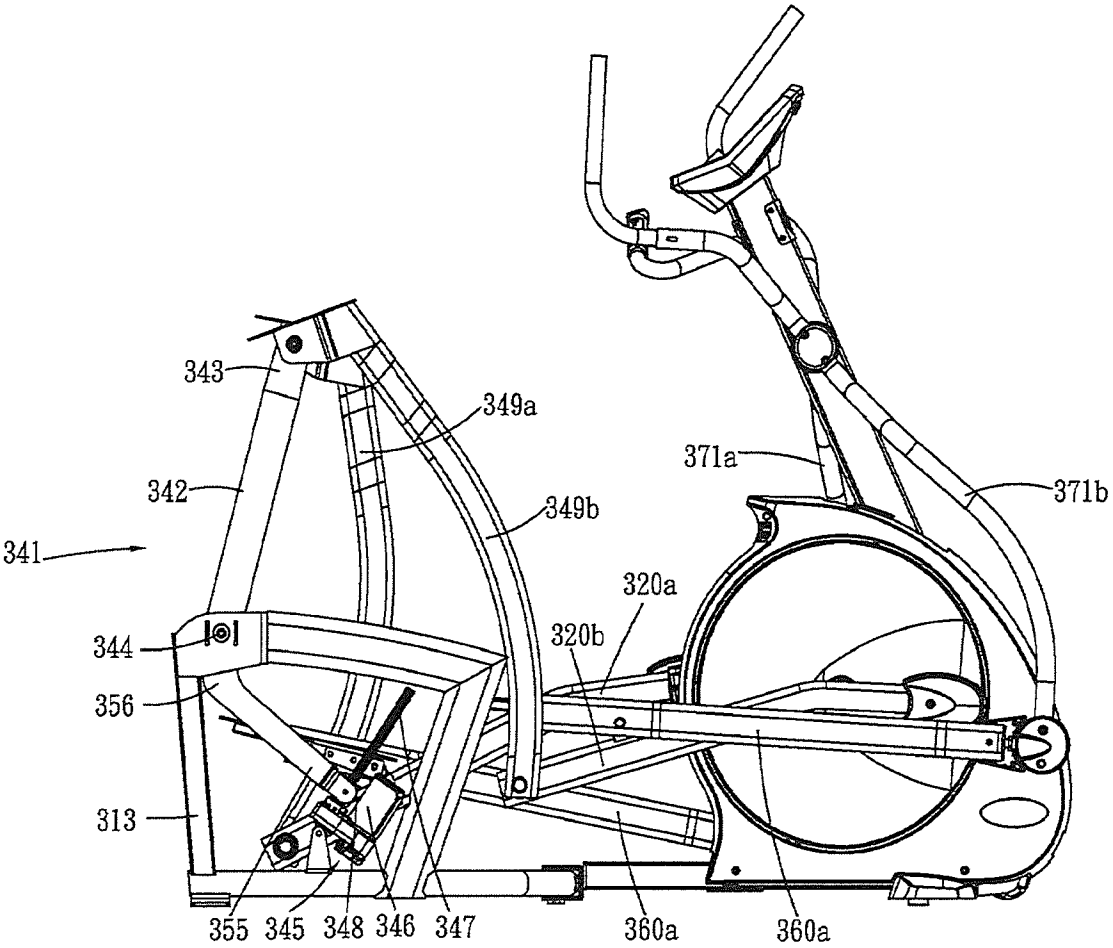
FIG. 15 is a side view of the stationary exercise apparatus of FIG. 14.
Figure 16:
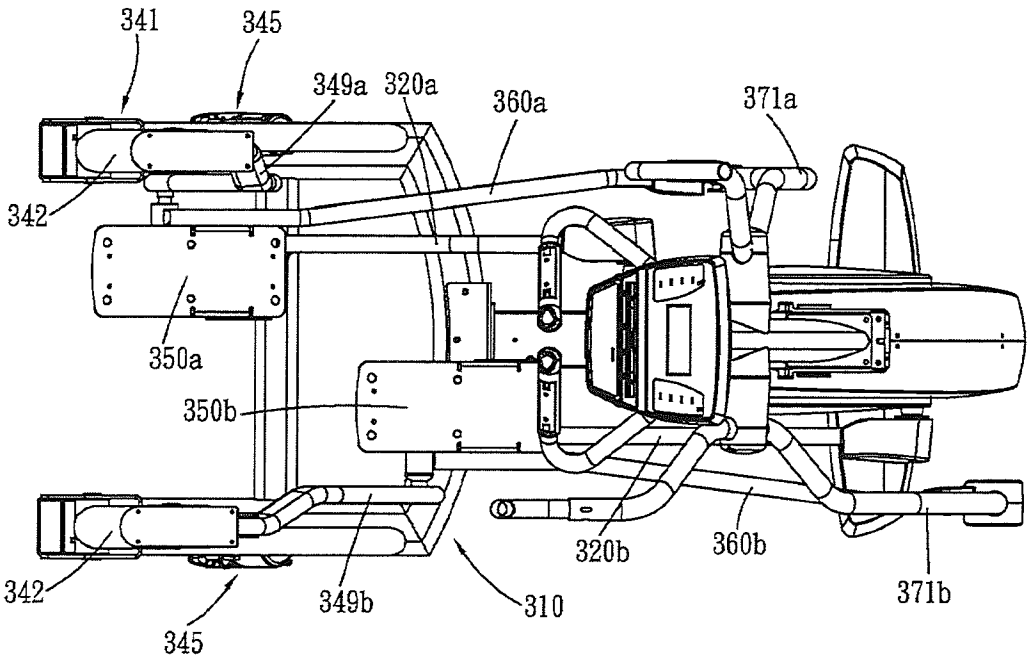
FIG. 16 is a top view of the stationary exercise apparatus of FIG. 14.

FIGS. 14 through 16 illustrate an embodiment similar to the embodiment illustrated in FIGS. 1 through 9. This third embodiment of a stationary exercise apparatus 300 includes a frame 310 having a base 311, a front portion 312, a rear portion 308, and side portions 313. The frame 310 may also include a post 314 and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are joined to the frame side portions 313 in a manner substantially similar to that described above in relation to the first embodiment 100.

There is also provided a moving assembly 341 including first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

In this embodiment of the exercise apparatus 300, the swing members 349*a*/349*b* are illustrated as arcuate in shape so that the support members 320*a*/320*b* need not extend rearward as far as those illustrated in previous embodiments. Otherwise, the operation of the swing member 349*a*/349*b* and the support members 320*a*/320*b* are essentially as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

Figure 20:
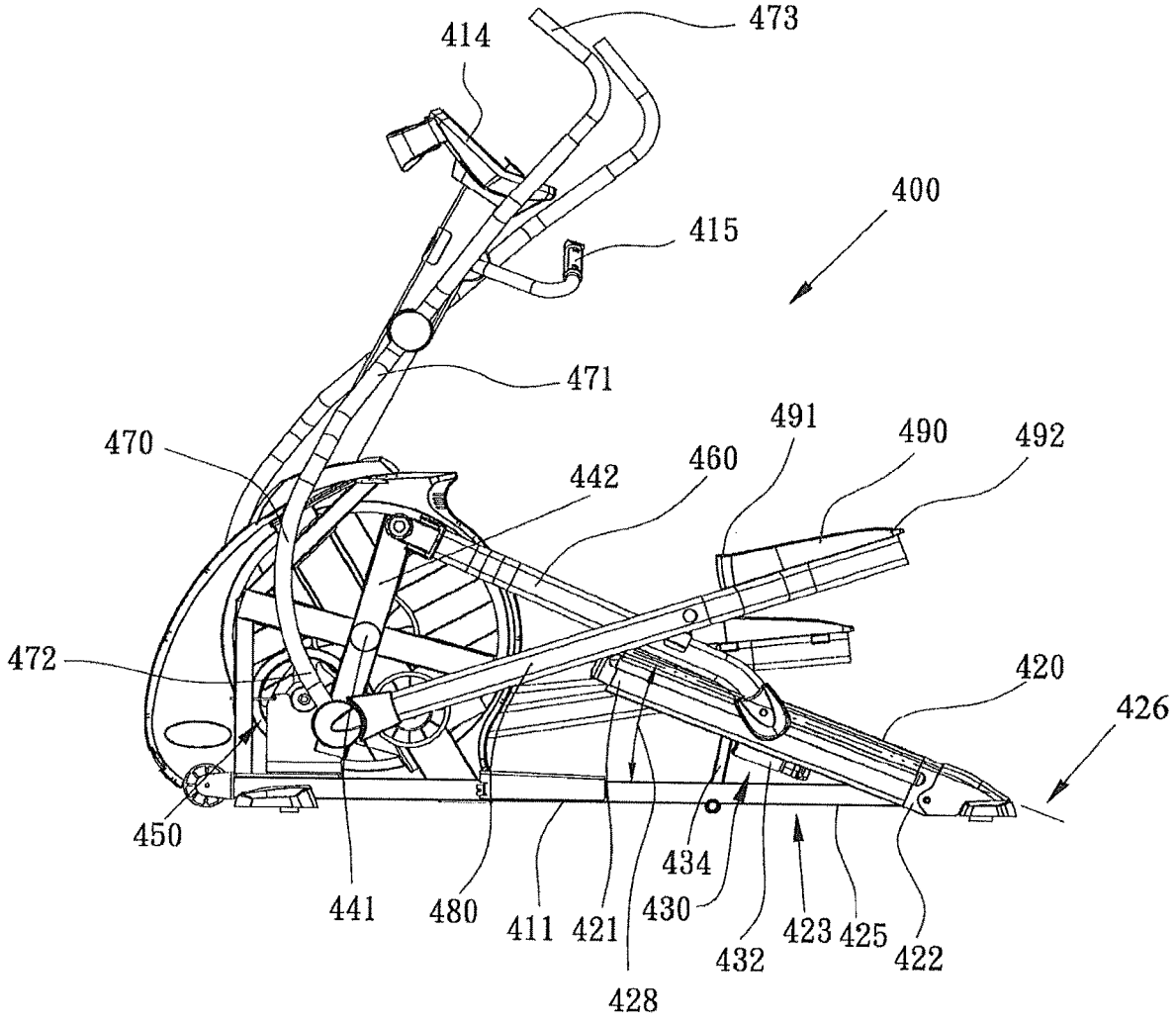
FIG. 20 is a left side view of the stationary exercise apparatus of FIG. 17 in a relatively high incline condition.
Figure 21:
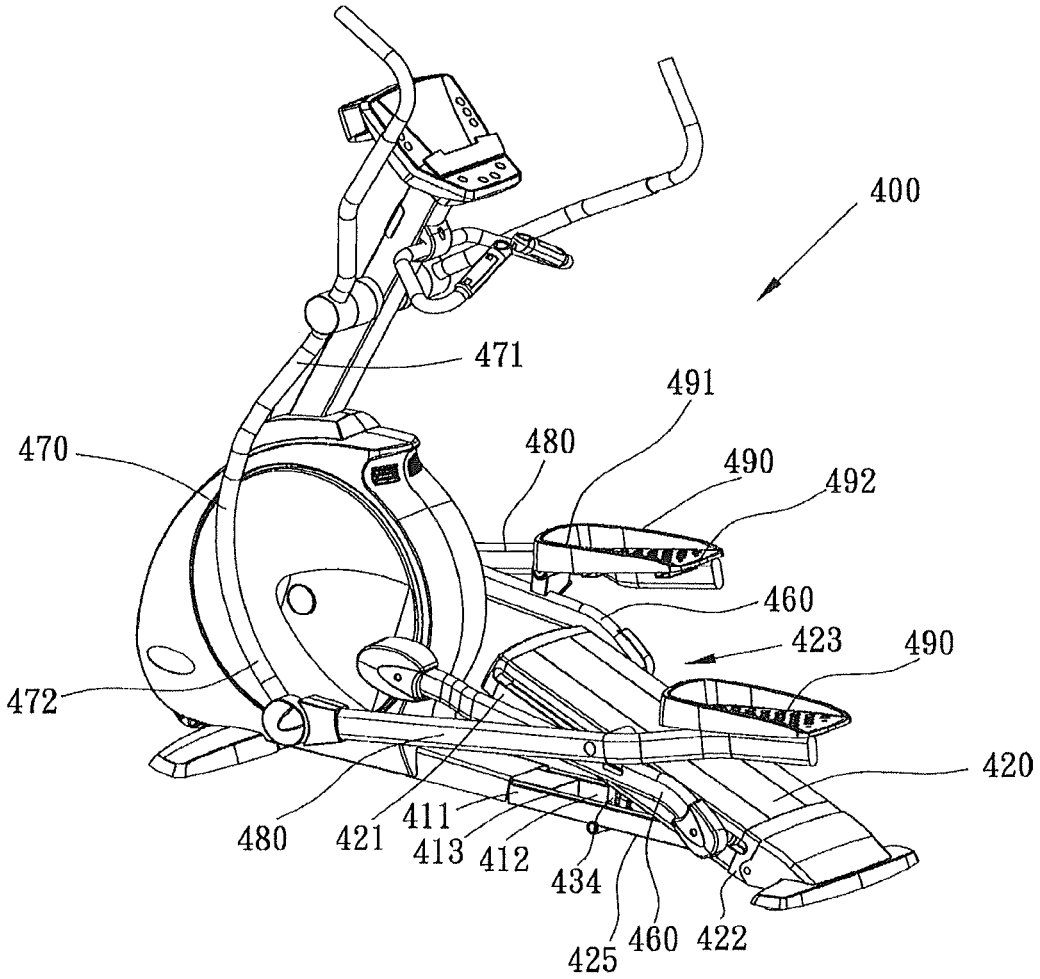
FIG. 21 is a left side perspective view of the stationary exercise apparatus of FIG. 17 in a relatively high incline condition.

FIGS. 17 through 21 illustrate an embodiment having substantial portion similar to the embodiments illustrated in FIGS. 1 through 16. This fourth embodiment of a stationary exercise apparatus 400 includes a frame 410 having a base and a rear portion 425 (FIG. 20). The frame 410 may also include a front portion having a post 412 and a standard 413. A fixed handle assembly 415 and a console 414 are also provided as described above in relation to the previous embodiments.

The fourth embodiment of the exercise apparatus 400 includes rotating members 418 that rotate about a first axis 441, similar to those described and illustrated in relation to the second embodiment 200 (FIGS. 10 through 13). An optional resistance assembly 450 is also provided.

Similar to the embodiment illustrated in FIGS. 1 to 9, the fourth embodiment of the exercise apparatus 400 also includes first and second supporting members 460, each having a first end portion 461 rotatably joined to the rotating members 418 and a second end portion 463. Preferably, the second end portion is coupled with some rollers or sliders for reciprocating movement on a surface such as a track surface. The second end portions 463 of the first and second supporting members 460 are respectively reciprocated on a guider assembly 423 which is coupled to the rear portion 425 of the base 411. There is more detail description of the guider assembly 423 hereinafter.

Figure 22:
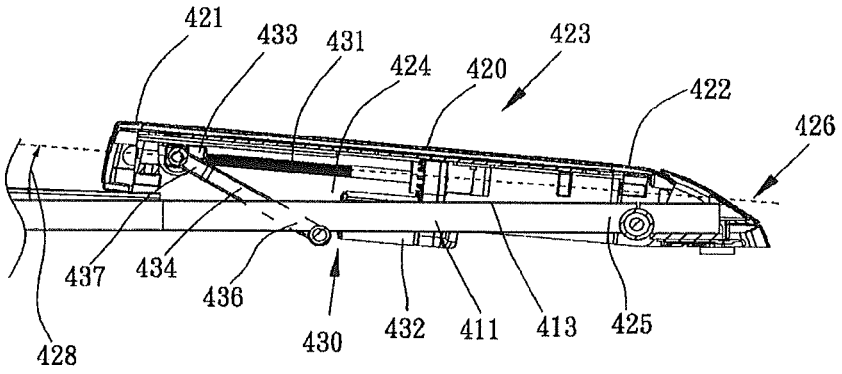
FIG. 22 is a left side view of the guide assembly of the stationary exercise apparatus of FIG. 17 in a relatively low incline condition.
Figure 23:
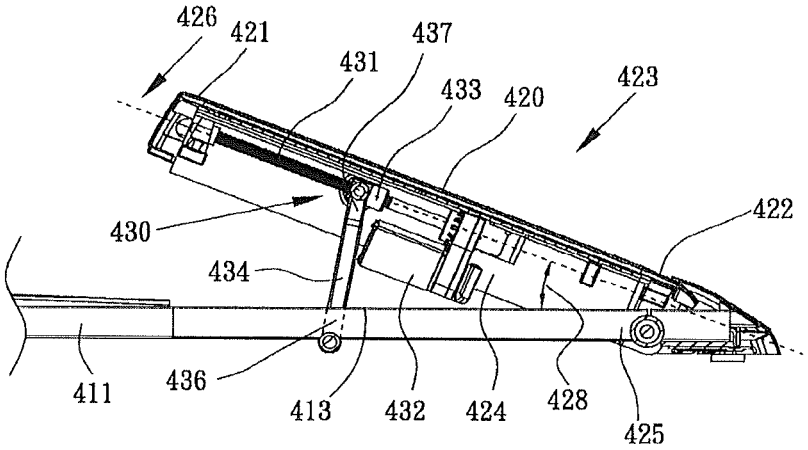
FIG. 23 is a left side view of the guide assembly of the stationary exercise apparatus of FIG. 17 in a relatively high incline condition.

Now referring to FIGS. 22 and 23, the guider assembly 423 comprises a guider 420 coupled to the rear portion 425 of the base 411 and a moving member 434 movably coupled between the guider 420 and the base 411. The guider 420 has a first end portion 421, and a second end portion 422 pivotally connected to the base 411. A reciprocating path 426 is defined between the first and second end portions 421/422 of the guider 420. In the embodiment illustrated in FIGS. 17 through 21, the guider 420 is a linear track to define the reciprocating path 426 substantially parallel to the surface of the guider 420. In other embodiments, the guider 420 could be a curved track (not shown), the reciprocating path 426 is a virtual linear line connecting first and second ends of the curved track. An incline angle 428 is defined by the reciprocating path 426 and the base 411 in both linear and curved track embodiments. More specifically, the incline angle 428 is defined by the reciprocating path 426 and the top horizontal surface of the base 411, or a ground surface on which the base 411 rests.

Figure 24:
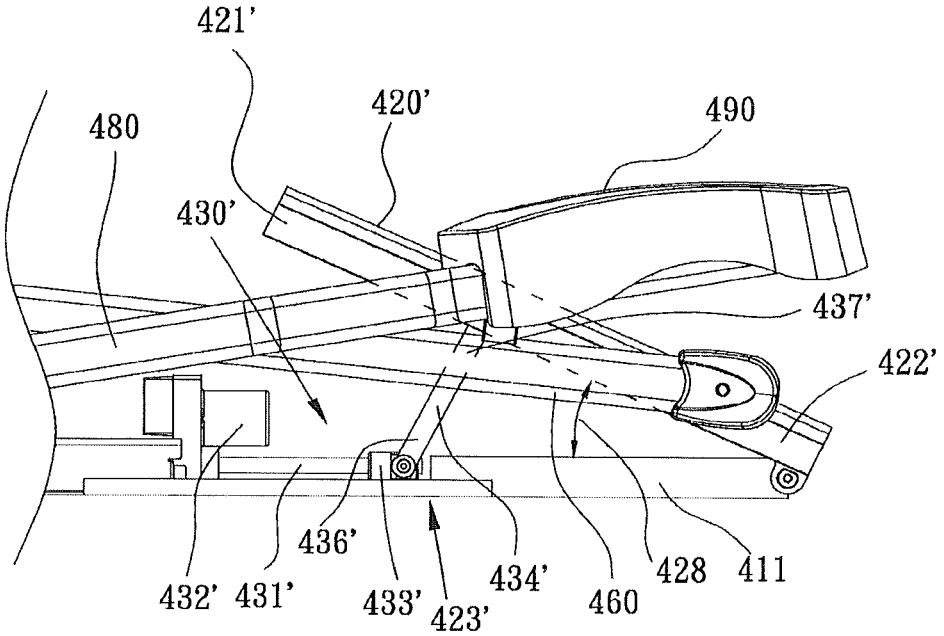
FIG. 24 is a left side view of an alternative embodiment of the guide assembly of the stationary exercise apparatus of FIG. 17 in a relatively high incline condition.

FIGS. 22 through 24 illustrate detailed views of the guider assembly 423 and an alternative embodiment of the guider assembly 423. In FIG. 22, the guider 420 is in a relatively low incline condition and the incline angle 428 defined by the guider 420 and the base 411 is about 5 degrees. The moving member 434 has a first end portion 436 pivotally connected to the base 411, and a second end portion 437 movably coupled to the guider 420. In FIG. 23, the second end portion 437 of the moving member 434 is selectively coupled to the guider 420 close to a middle position between the first and second end portions 421/422 of the guider 420. In the arrangement of FIG. 23, the moving member 434 is inclined further upwardly, and the incline angle 428 is increased to about 22 degrees. The exercise apparatus 400 is in a relatively high incline condition when the incline angle 428 is about 22 degrees.

An optional adjusting assembly 430 is provided under the guider 420 in the embodiment shown in FIGS. 22 and 23. The adjusting assembly 430 activates the moving member 434 electronically to vary the incline angle 428. The adjusting assembly 430 includes a motor 432, a screw rod 431, and a threaded nut, sleeve, or tube 433. The motor 432 is connected to the screw rod 431 for driving the screw rod 431. In this embodiment, the screw rod 431 is mounted under the guider 420 in an orientation generally parallel to the reciprocating path 426. The screw rod 431 is threaded through the tube 433, which is pivotally mounted on the second end portion 437 of the moving member 434. In this manner, the motor 432 can be activated automatically or manually from the console 414 to rotate the screw rod 431, which in turn pushes or pulls the tube 433 along the screw rod 431. As the tube 433 is pushed or pulled, the second end portion 437 of the moving member 434 is movably coupled between the guider 420 and the base 411. A manually operated adjusting assembly could also be used, as described above.

The guider assembly 423' shown in FIG. 24 is an alternative embodiment of the guider assembly 423 shown in FIGS. 22 and 23. The guider assembly 423' also includes a guider 420' coupled to the base 411, and a moving member 434' having a first end portion 436' movably coupled to the base 411, and a second end portion 437' pivotally connected to the guider 420'. In FIG. 24, the first end portion 436' of the moving member 434' is selectively coupled to the base 411 and the second end portion 437' is pivotally connected to the guider 420' closed to a middle position of the guider 420'. The middle position is between first second end portions 421'/422' of the guider 420'. There is also an optional adjusting assembly 430' mounted on the base 411. Similar to what is described previously; the adjusting assembly 430' can also activate the moving member 434' to vary the incline angle 428.

There are also other alternative embodiments of the guider assembly 423' shown in FIG. 24. For example, the screw rod 431' could be replaced by a bracket mounting on the base 411 with several receiving notches positioned substantially horizontally. Then, the first end portion 436' of the moving member 434' could selectively be coupled to one of the receiving notches by manual operation of a user in order to vary the incline angle 428. Another example is that the moving member 434' comprises a pair of telescopic tubes which can be contracted or expanded to each other when the incline angle 428 is decreased or increased. In the embodiment of the telescopic tubes, both first and second end portions 436'/437' of the moving member 434' are pivotally connected to the base 411 and the guider 420'. The telescopic tubes could be selectively locked to each other for different incline angles of the guider 420'.

In addition to the benefits described in the previous embodiments shown in FIGS. 1 through 16, the embodiments shown in FIGS. 17 through 24 further have the following advantages. Substantial portions of both the moving member 434 and adjusting assembly 430 could be hidden by the base 411 and the guider assembly 423 which further comprises a shroud 424 (FIG. 23) when the incline angle 428 is in the condition of FIG. 19 or 22, the relative low incline condition. Therefore, appearance of the stationary exercise apparatus 400 is more compact and succinct in the relative low incline condition. Further, the positioning of the adjusting assembly 430 under the guider 420 permits a more compact appearance, while allowing for efficient transfer of mechanical force from the adjusting assembly 430 to the guider 420. Also, in a preferred embodiment, the base 411 can include an access hatch 412 to permit ready access to the adjusting assembly 430 and the guider 420. The access hatch 412 is located below the top surface 413 of the base 411 in order to access or hide some portion of the adjusting assembly 430 and the moving member 434 when the guider 420 is at the lowest incline condition as shown in FIG. 22.

Figure 17:
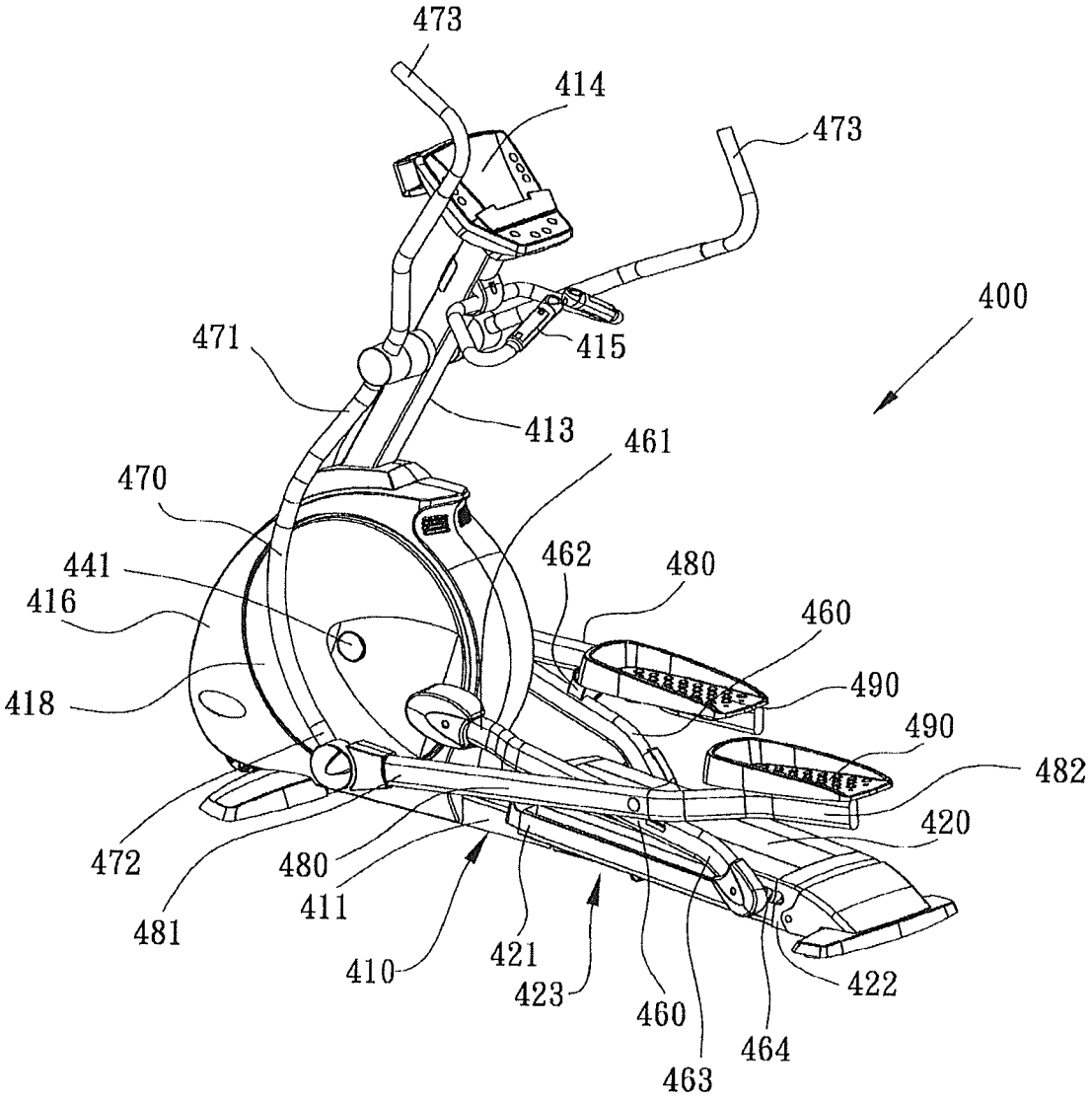
FIG. 17 is a left side perspective view of a fourth embodiment of a stationary exercise device in accordance with the present disclosure.
Figure 18:
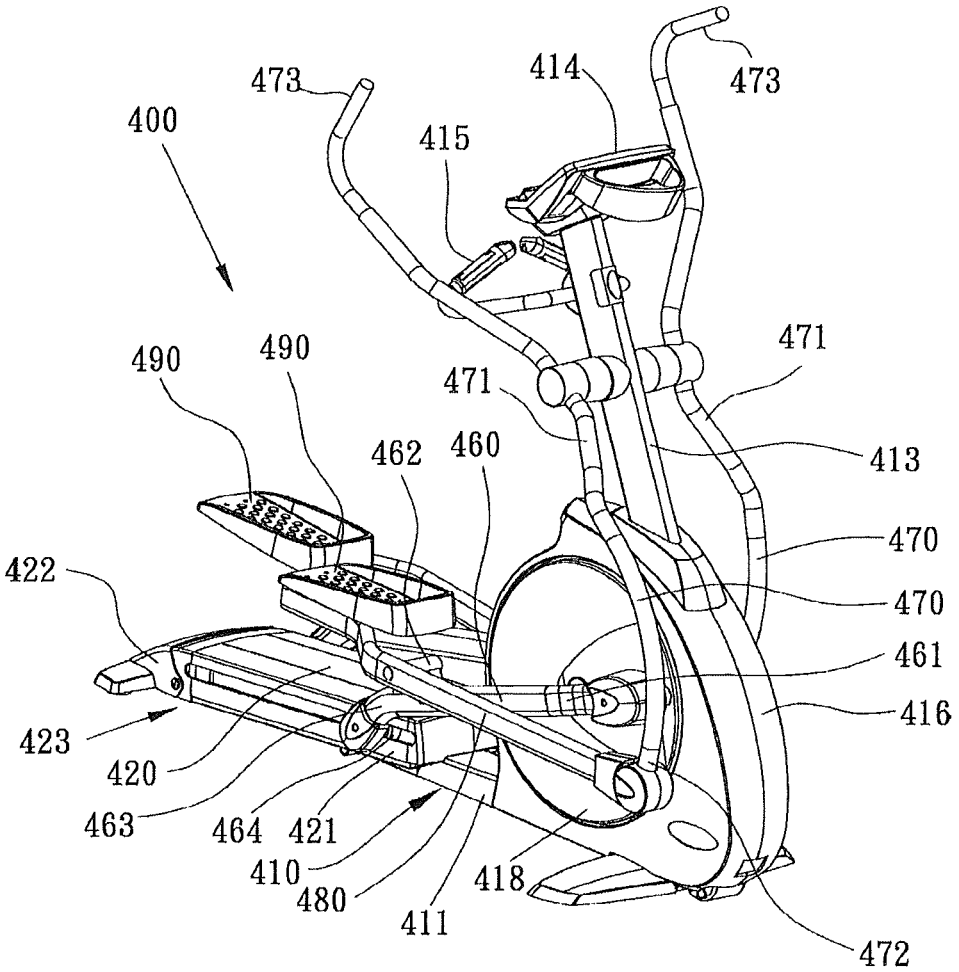
FIG. 18 is a right side perspective view of the stationary exercise apparatus of FIG. 17.
Figure 19:
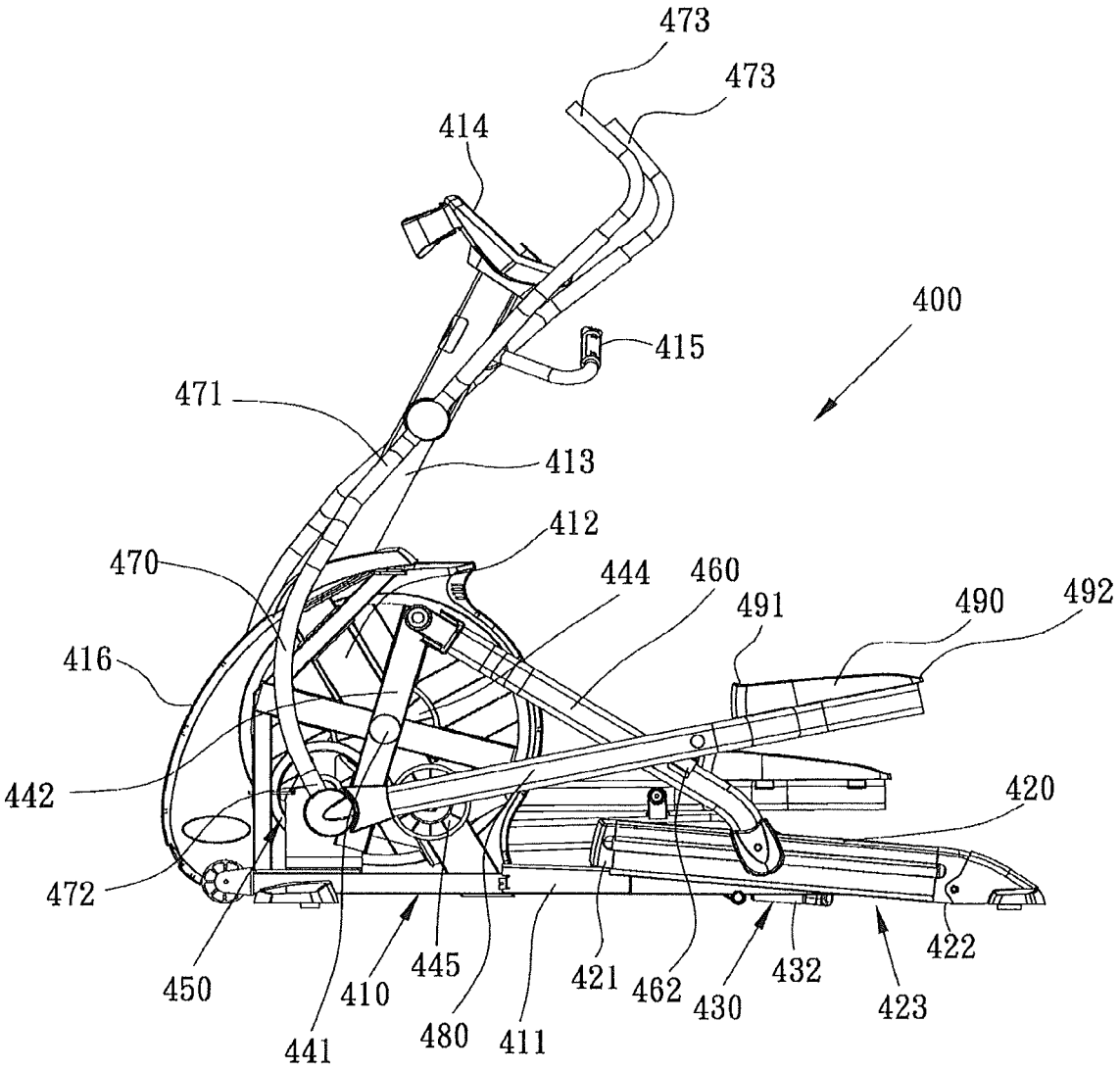
FIG. 19 is a left side view of the stationary exercise apparatus of FIG. 17 in a relatively low incline condition.

Now referring to FIGS. 17 and 20, first and second pedals 490 are respectively coupled to the first and second supporting members 460, either directly or indirectly as described above. Each of the pedals 490 respectively has a front end portion 491 and a rear end portion 492. To couple the pedals 490 indirectly to the support members 460, there are provided first and second control links 480 which are pivotally connected to the supporting members 460. The pedals 490 are joined to the control links 480 and move in a second closed loop path 498 and a third closed loop path 497 when the supporting members 460 move as described above.

Handle links 470 are illustrated for this embodiment, and as with the above embodiments, may be substituted by tracks, rollers, sliders, and the like to provide support for the moving first end portions 481 of the control links 480. Any such device is referred to herein as a "handle link" regardless of whether it actually serves as a handle for a user.

Figure 25:
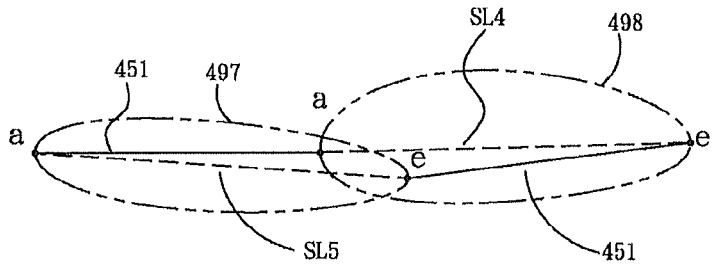
FIG. 25 shows toe and heel path profiles of the stationary exercise apparatus of FIG. 17 in a relatively low incline condition.
Figure 26:
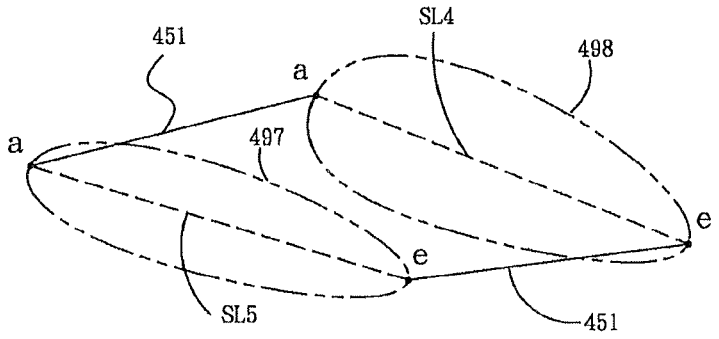
FIG. 26 shows toe and heel path profiles of the stationary exercise apparatus of FIG. 17 in a relatively high incline condition.

FIGS. 25 and 26 are path profiles and information of the stationary exercise apparatus 400 when the guider 420 is in the relatively low and high incline conditions. The points a and e are also correspondent to the foremost and rearmost positions when the first ends of the first and second supporting members 460 are rotating about the first axis 441. Similar to described above, second and third closed loop paths 498/497 are respectively representing the moving paths of the heel and toe portions of a user of the stationary exercise apparatus 400; stride lengths SL4 and SL5 are respectively representing the stride lengths of the heel and toe portions of a user of the stationary exercise apparatus 400 similar to the description of FIG. 9.

Stride length is relative to exercise intensity and a longer stride length generally results in higher exercise intensity. In FIG. 25, the stride length SL4 is substantially same with the stride length SL5. But, comparing the stride length SL4 with the stride length SL5 in FIG. 26, the stride length SL4 is longer than the stride length SL5 when the stationary exercise apparatus 400 is in the relatively high incline condition. That is, the length of the stride length SL4 is greater than the length of the stride length SL5 when the guider 420 is adjusted from a relatively low incline condition to a relatively high incline condition. Therefore, the heel portion and gluteus portion of a user are having higher exercise intensity when the stationary exercise apparatus 400 is in the relatively high incline condition.

The orientation of the pedals 490 can be simply illustrated by a pedal orientation 451 as shown in FIGS. 25 and 26, a connection between the front and rear ends of the pedals 490. One important character of the pedal orientation 451, in the foremost position a, is that the steepness of the pedal orientation 451 is increased forwardly when the guider 420 is adjusted from the relatively low incline condition to the relative high incline condition. That is, in the foremost position a, the rear end portion 492 is moved upwardly at a faster rate than the front end portion 491 of the pedals 490 when the guider 420 is adjusted from the relatively low incline condition to the relative high incline condition. Simply speaking, in the foremost position a, the rear end portion 492 is moved higher than the front end portion 491 of the pedals 490 when the incline angle 428 is increased. Since the steepness, in the foremost position a, of the pedal orientation 451 is more obvious in the relatively high incline condition, the heel portion of a user is elevated more obvious than the toe portion of a user, therefore the gluteus of the user could be fully exercised as described above.

Figure 27:
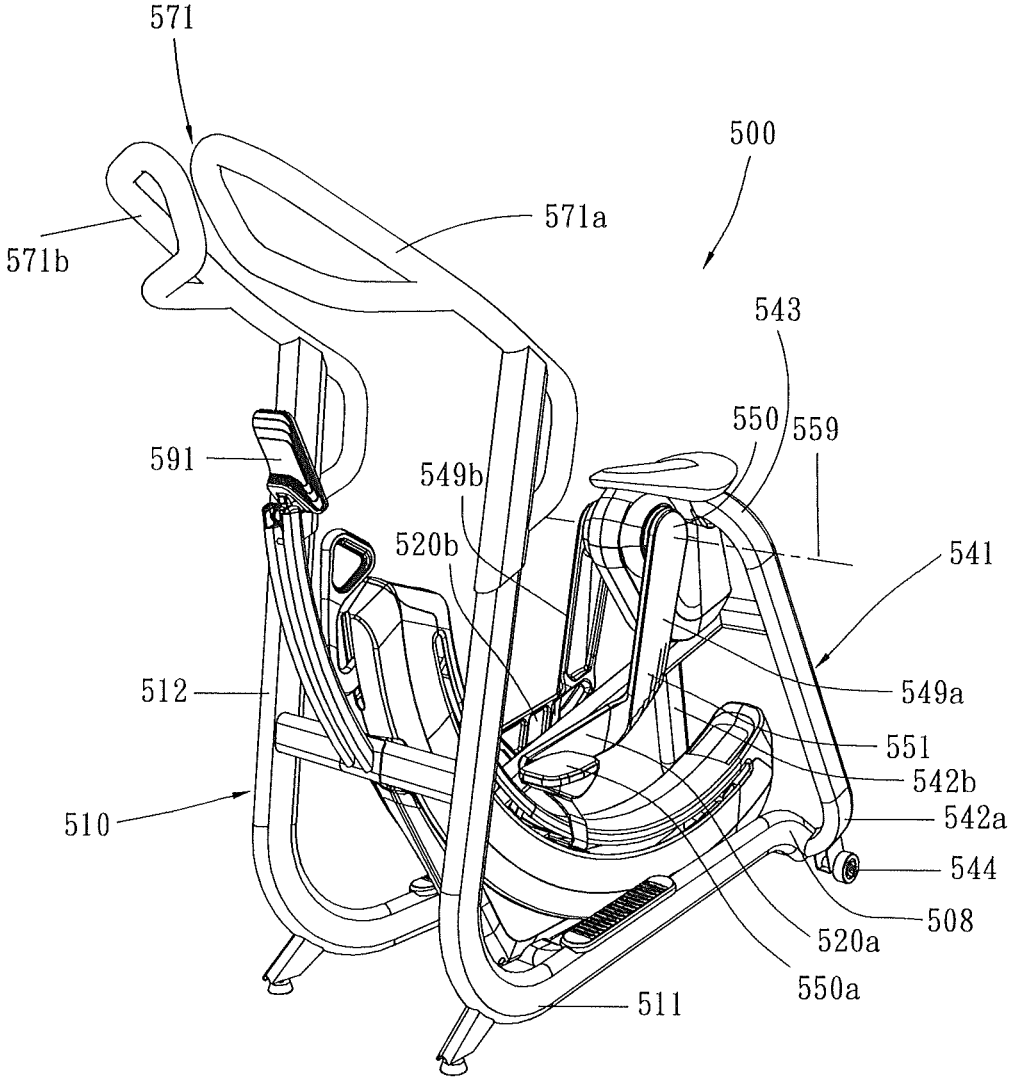
FIG. 27 is a perspective view of a stationary exercise apparatus according to a fifth embodiment of the present disclosure.
Figure 28:
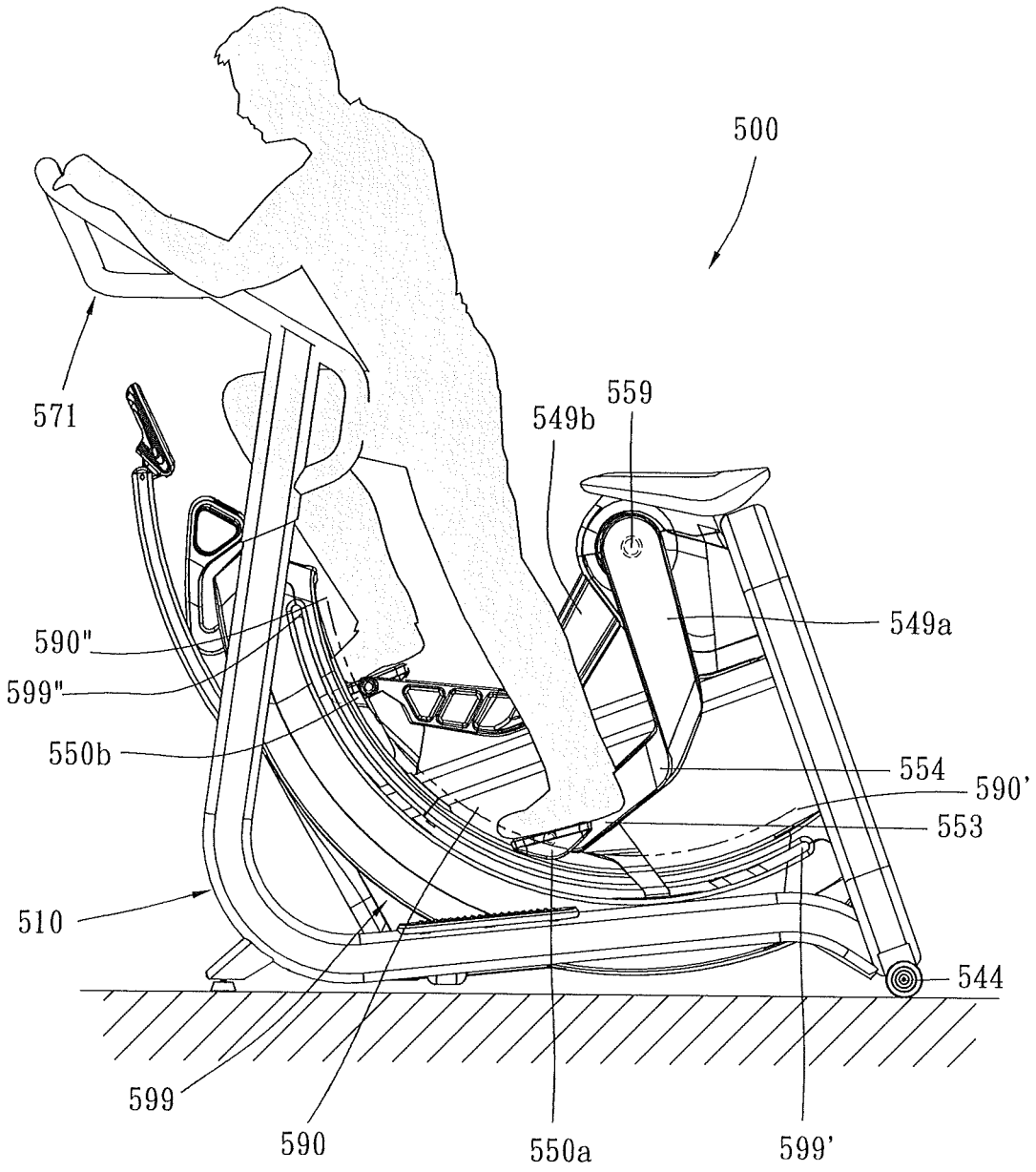
FIG. 28 is a side view of the stationary exercise apparatus of FIG. 27

FIGS. 27 and 28 illustrate the fifth embodiment of the present disclosure. This fifth embodiment of a stationary exercise apparatus 500 includes a frame 510 having a base 511, a front portion 512, and a rear portion 508. A fixed handle assembly 571 including a left handle link 571*a* and a right handle link 571*b* and a console 591 are also provided as described above in relation to the previous embodiments. The base 511 is substantially a horizontal frame adapted to stably rest on a ground, floor or other similar supporting surface.

Referring to FIGS. 27 and 28, the frame 510 further includes a moving assembly 541 mounted thereon. In the embodiment, the moving assembly 541 has first and second moving members 542*a*/542*b*, in a generally upright position. The first and second moving members 542*a*/542*b* are coupled to the frame via a first axis 544 so that the upper end portions of the moving members 542*a*/542*b* can be adjusted by pivoting the moving members 542*a*/542*b* about the first axis 544. Besides, a lateral link 543 connects the first and second moving members 542*a*/542*b* such that the two moving members 542*a*/542*b* are located collaboratively to define a swing axis 559. As previous mentioned, the stationary exercise apparatus 500 may also include an adjusting assembly (not shown) mounted between the moving assembly 541 and the frame 510 for adjusting the moving assembly 541 back and forth as previous described. Although described and illustrated as a screw adjusting mechanism in the previous embodiment, the adjusting assembly could be any manual or automatic mechanical, electromechanical, hydraulic, or pneumatic device and be within the scope of the invention.

Still referring to FIGS. 27 and 28, the stationary exercise apparatus 500 further includes first and second swing members 549*a*/549*b*, and each of the swing members 549*a*/549*b* has an upper portion 550 and a lower portion 551. The upper portions 550 of the first and second swing members 549*a*/549*b* are coupled to the frame 510 via the swing axis 559 for swinging motion relative to the frame 510. In one preferred embodiment of the present disclosure, the upper portions 550 of the first and second swing members 549*a*/549*b* are respectively pivoted to the first and second moving members 542*a*/542*b* via the swing axis 559 and the moving members 542*a*/542*b* are pivoted to rotate about the first axis 544 so that the swing axis 559 can be adjusted forward or backward relative to the front 512 of the frame 510. As previous mentioned, different positions of the swing axis 559 cause different exercise intensity of the stationary exercise apparatus 500. Besides, each of the swing members 549*a*/549*b* includes a first extending direction extending from the upper portion 550 to the corresponding lower portion 551.

As disclosed in FIGS. 27 and 28, the stationary exercise apparatus 500 further includes first and second supporting members 520*a*/520*b*, and each of the first and second supporting members 520*a*/520*b* has a first end portion 553 and a second end portion 554. The first end portions 553 of the first and second supporting members 520*a*/520*b* are respectively movably coupled to the frame 510. The second end portions 554 of the first and second supporting members 520*a*/520*b* are respectively joined to the lower portions 551 of the first and second swing members 549*a*/549*b* so that the first end portions 553 of the first and second supporting members 520*a*/520*b* may be moved along a first path 590 which is a reciprocating path and includes an arc while the second end portions 554 of the first and second supporting members 520*a*/520*b* are being rotated about the swing axis 559. Besides, the stationary exercise apparatus 500 further includes first and second pedals 550*a*/550*b* respectively coupled to the first and second supporting members 520*a*/520*b*. In the present embodiment, because the first and second pedals 550*a*/550*b* are pivotally connected to the first end portions 553 of the first and second supporting members 520*a*/520*b*, the first and second pedals 550*a*/550*b* could move along the same first path 590 with the orientations thereof are respectively adjustable relative to the supporting members 520*a*/520*b*. In this embodiment, each of the supporting members 520*a*/520*b* extends along a second extending direction from the first end portion 553 to the corresponding second end portion 554, and the second extending direction is different from the corresponding first extending direction for the sake of user's convenience and comfort.

In the embodiment, the stationary exercise apparatus 500 further includes a gearing structure (not shown) connecting the first and second pedals 550*a*/550*b*. Because of the gearing structure, the user could step on the first and second pedals 550*a*/550*b* and exercise with one leg lifted and the other leg pressed alternatively and slide reversely relative to a balance position (Not shown, about the middle point of the reciprocating path 590) of the pedals along the reciprocating path 590. Besides, because one front stop position and one rear stop position are predetermined by a path controlling structure 599 and the pedals 550*a*/550*b* are engaged in the track of the path controlling structure 599, the pedals 550*a*/550*b* move reversely and symmetrically relative to the balance position until up to the upmost front stop position 599" of the path controlling structure 599 and down to the lowest rear stop position 599' thereof. The reciprocating path 590 therefore comprises a front end 590" and a rear end 590' accordingly. Besides, as illustrated in the embodiment, the swing axis 559 is positioned higher than the front end 590", but it is not limited thereto.

Figure 29:
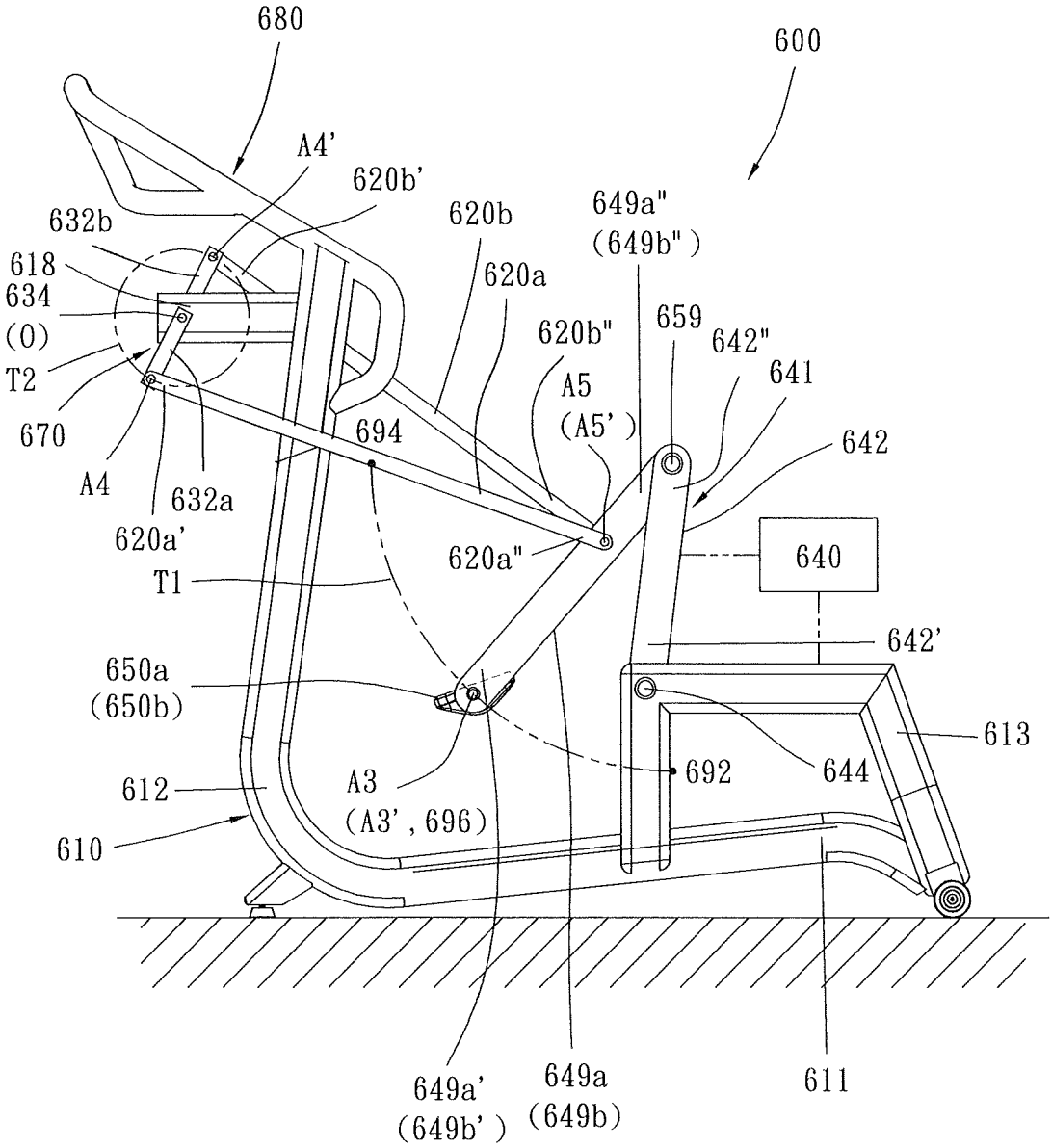
FIGS. 29~31 are perspective side views of a stationary exercise apparatus according to a sixth embodiment of the present disclosure with the swing axis in a first position, in a second position, and in a third position.

Now referring to FIG. 29, a stationary exercise apparatus 600 of the sixth embodiment is illustrated therein. The stationary exercise apparatus 600 has a frame 610 generally comprising a base 611, a front portion 612, and side portions 613. The base 611 is substantially a horizontal frame adapted to stably rest on a ground, floor or other similar supporting surface. The front portion 612 is fixed on the base 611. The side portions 613 are respectively mounted on the left and right sides of the base portion 611 (Only one side portion 613 is shown, the other side portion 613 is superimposed thereon from the side view.). A fixed handle assembly 680 and a console (not shown) could be optionally mounted on or near the upper end of the front portion 612. One crank mechanism 670 including left and right cranks 632*a*/632*b* respectively pivoted to one extension portion 618 of the frame 610 and rotating about a first axis 634. The first axis 634 is at or near the front portion 612 of the frame 610. The left and right cranks 632*a*/632*b* can be replaced by a pair of disks, flywheels, or other device rotating about the first axis 634. The left and right cranks 632*a*/632*b* and the first axis 634 can also be replaced by a pair of closed tracks circulating about a virtual axis, as opposed to an axis defined by a wheel axle. The same as the previous embodiment, the frame 610 may further comprise a pulley (not shown) and a resistance member (not shown) which is controlled by using the console to vary operating resistance for a user.

Figure 30:
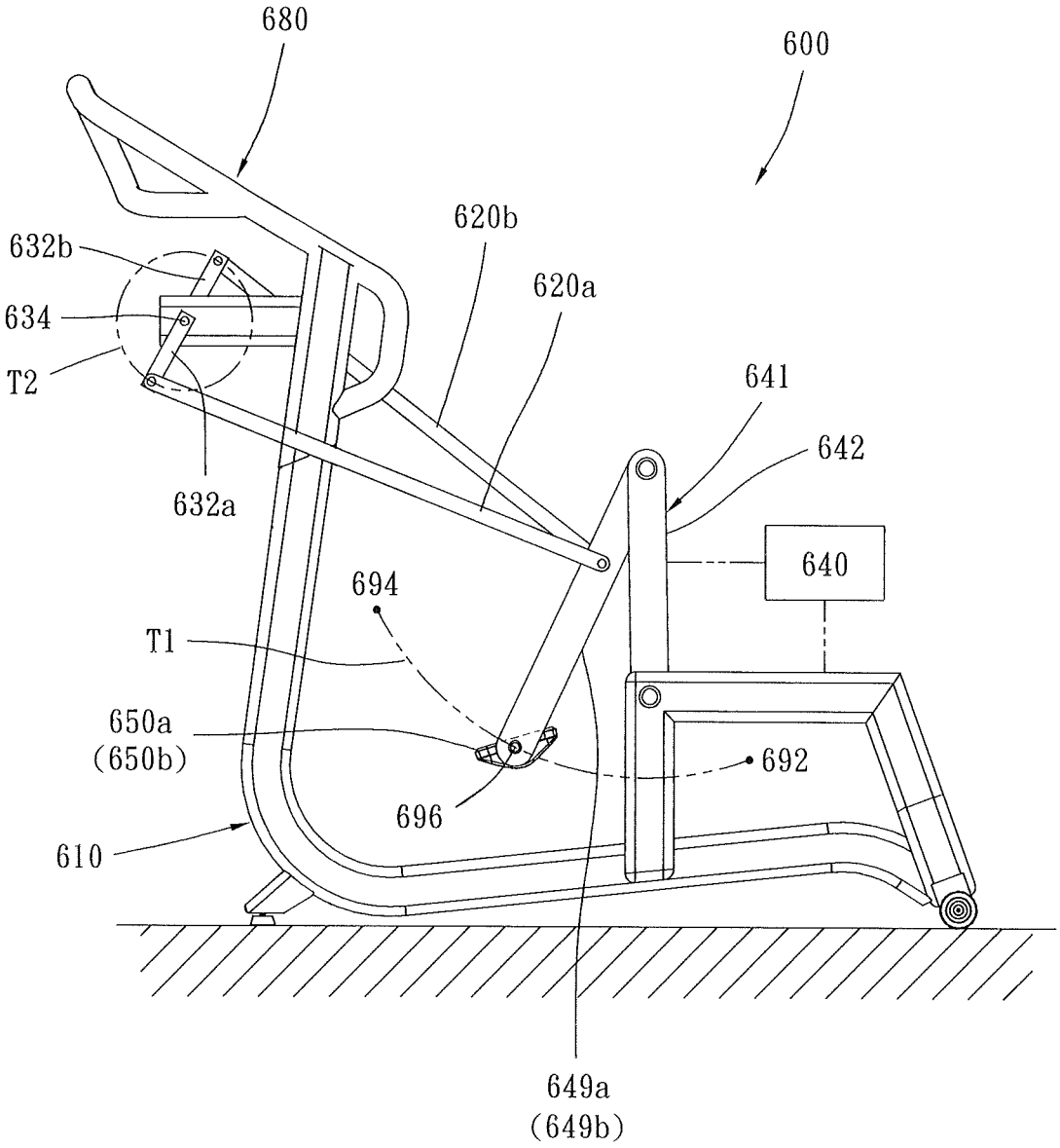
Figure 31:
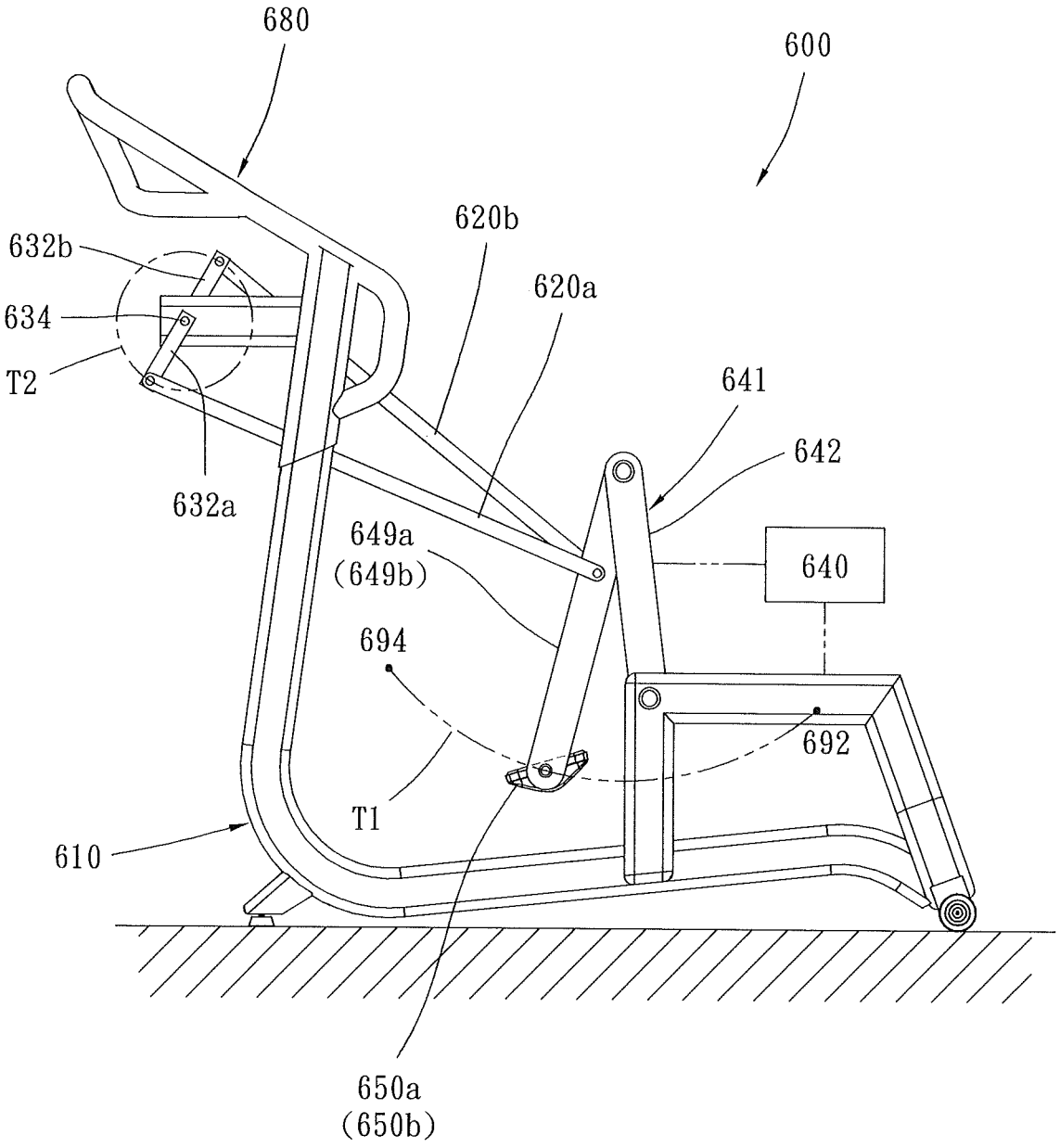

Now referring to FIGS. 29 to 31, the frame 610 further comprises a moving assembly 641 mounted on the side portions 613. In a preferred embodiment of the present disclosure, the moving assembly 641 has first and second moving members 642 (Only one moving member 642 is shown, the other moving member 642 is superimposed thereon from the side view.), in a generally upright position (FIG.30), and a lateral link (not shown) connecting the first and second moving members 642 to one another. The first and second moving members 642 are pivotally coupled to the side portions 613 of the frame 610 via a second axis 644 so that the upper end portions 642" of the first and second moving members 642 can be adjusted by pivoting the first and second moving members 642 about the second axis 644. Here, a driving adjusting assembly 640 may be mounted between the moving assembly 641 and the frame 610 for adjusting the moving assembly 641 to rotate about the second axis 644. The driving adjusting assembly 640 has one end connected to the frame 610 and the other end connected to the moving assembly 641 so that the moving assembly 641 is adjustable to be moved relative to the frame 610. Since the moving members are respectively pivotally connected to the frame 610 with their lower end portions 642' at the second axis 644, when the lower end portions 642' move about the second axis 644, the upper end portions 642" of the first and second moving members 642 are adjustable fore and aft relative to the front portion 612 between a first position as shown in FIG. 29 and a third position as shown in FIG. 31. Not only being as a screw adjusting mechanism, the adjusting assembly 640 but also could be any manual or automatic mechanical, electromechanical, hydraulic, or pneumatic device and be within the scope of the invention.

Still referring to FIGS. 29 to 31, the stationary exercise apparatus 600 further includes first and second swing members 649*a*/649*b*, each of the swing members 649*a*/649*b* having an upper portion 649*a*" or 649*b*" and a lower portion 649*a*' or 649*b*'. The upper portions 649*a*"/649*b*" of the first and second swing members 649*a*/649*b* can be coupled to the frame 610 via a swing axis 659 which is collaboratively defined by the upper end portions 642" of the first and second moving members 642 for swinging motion relative to the frame 610. In the present embodiment, the upper portions 649*a*"/649*b*" of the swing members 649*a*/649*b* are respectively pivoted to the upper end portions 642" of the moving members 642 via the swing axis 659 and the moving members 642 are pivoted to rotate about the second axis 644 so that the swing axis 659 can be adjusted forward or backward anywhere between the first position shown in FIG. 29 and the third position shown in FIG. 31. Different positions of the swing axis 659 could cause different exercise intensity of the stationary exercise apparatus 600. In other words, the swing axis 659 is movable toward and away from the front portion 612 of the frame 610. Besides, each of the swing members 649*a*/649*b* includes a first extending direction extending from the upper portions 649*a*"/649*b*" to the corresponding lower portion 649*a*'/649*b*'.

In addition, the stationary exercise apparatus 600 further includes first and second supporting members 620*a*/620*b*, each of the supporting members 620*a*/620*b* having a first end portion 620*a*' or 620*b*' and a second end portion 620*a*" or 620*b*". The first end portions 620*a*'/620*b*' of the first and second supporting members 620*a*/620*b* are respectively movably coupled to the frame 610 to rotate about the first axis 634. In the embodiment, the first end portions 620*a*'/620*b*' of the supporting members 620*a*/620*b* are respectively pivoted to the left and right cranks 632*a*/632*b* to rotate about the first axis 634. The second end portions 620*a*"/620*b*" of the supporting members 620*a*/620*b* are respectively pivoted joined to predetermined portions of the swing members 649*a*/649*b* to rotate about the supporting axes A5/A5' so that the lower portions 649*a*'/649*b*' of the first and second swing members 649*a*/649*b* could be moved along a reciprocating path T1 while the first end portions 620*a*'/620*b*' of the supporting members 620*a*/620*b* are being rotated about the first axis 634. In this embodiment, each of the supporting members 620*a*/620*b* extends along a second extending direction from the first end portion 620*a*' or 620*b*' to the corresponding second end portion 620*a*" or 620*b*", and each of the second extending directions is different from the corresponding each of the first extending directions.

Still referring to FIGS. 29 to 31, the stationary exercise apparatus 600 includes first and second pedals 650*a*/650*b* respectively coupled to the first and second supporting members 620*a*/620*b*. In the embodiment, the pedals 650*a*/650*b* are respectively indirectly connected to the supporting members 620*a*/620*b*. More specifically, the pedals 650*a*/650*b* are respectively pivotally attached to the lower portions 649*a*'/649*b*' of the swing members 649*a*/649*b* about third axes A3/A3' and the swing members 649*a*/649*b* are respectively pivotally connected to the supporting members 620*a*/620*b*. Therefore, the pedals 650*a*/650*b* are directed by the supporting members 620*a*/620*b* to move along a reciprocating path T1 while the first end portions 620*a*'/620*b*' of the supporting members 620*a*/620*b* are rotating about the first axis 634. Besides, the orientations of the pedals 650*a*/650 are respectively adjustable relative to the corresponding supporting members 620*a*/620*b*.

As illustrated in FIG. 29, the reciprocating path T1 of the swing members 649*a*/649*b* has a rear end 692, a front end 694, and a balance position 696 where the pedals 650*a*/650*b* are substantially overlapping to each other from a side view. In most situations, the balance position 696 is substantially the middle point between the rear end 692 and the front end 694. As the side view illustrated, left and right cranks 632*a*/632*b* are pivoted to the extension portion 618 of the frame 610 at a center O and rotated about the first axis 634. Two external terminals A4/A4' of the cranks 632*a*/632*b* are fixedly positioned 180 degrees away from each other and moving along a round path T2 correspondingly. Because the first end portions 620*a*'/620*b*' of supporting members 620*a*/620*b* are respectively connected to the external terminals A4/A4' and joined to the swing members 649*a*/649*b*, the swing members 649*a*/649*b* are directed to move toward opposite directions relative to the balance position 696 accordingly. Basically, the user could step on the pedals 650*a*/650*b* and slide back and forth along the reciprocating path T1 with one leg lifted up and the other leg pressed alternatively and symmetrically relative to the balance position 696. In addition, in the crank mechanism 670, because the cranks 632*a*/632*b* could rotate 360 degrees about the first axis 634, the first end portions 620*a*'/620*b*' respectively pivoted to the external terminals A4/A4' could rotate along the round path T2 which includes at least an arc accordingly.

Figure 32:
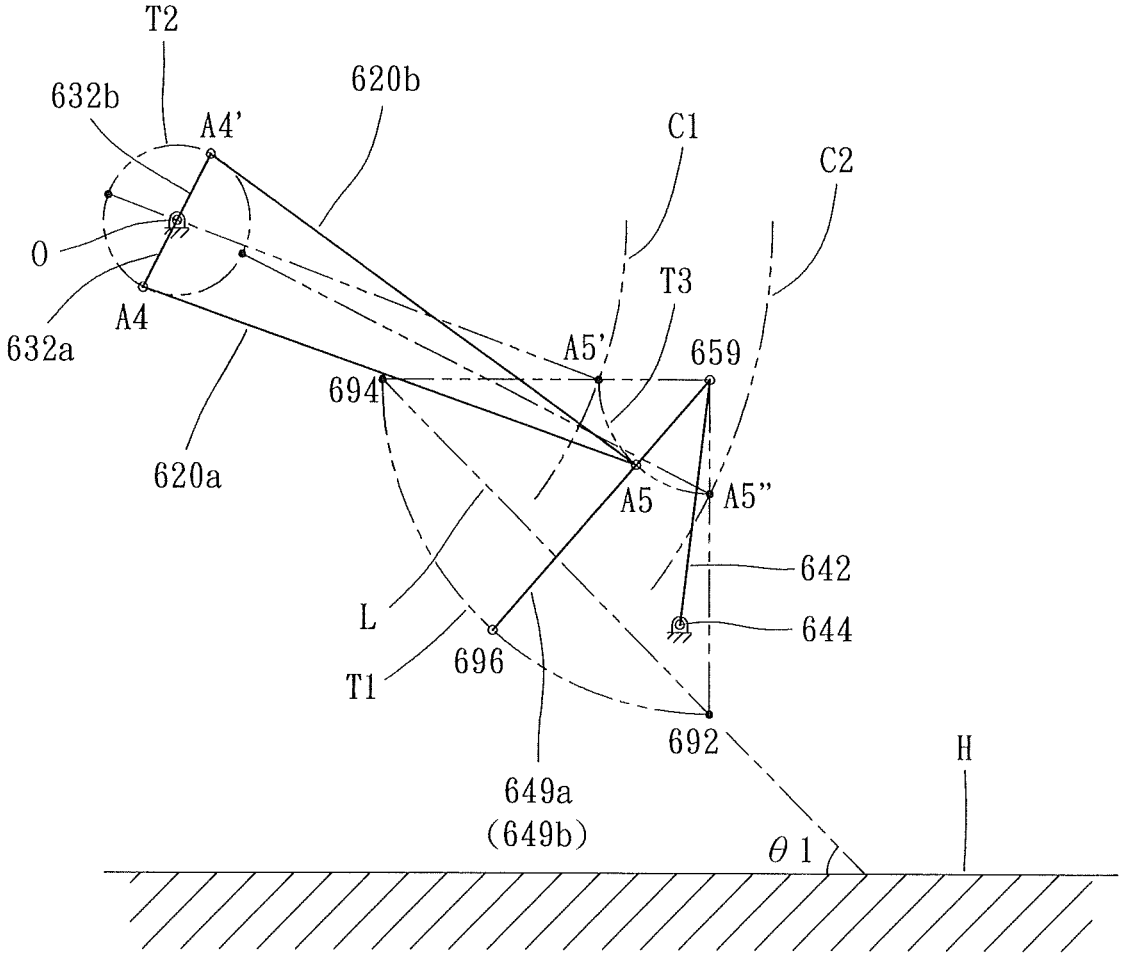
FIGS. 32~34 are path information and geometry parameters of the stationary exercise apparatus of FIGS. 29~31 in a first position, in a second position, and in a third position.

Now referring to FIG. 32, FIG. 32 shows the path information and geometry parameters of the stationary exercise apparatus 600 in a first position while the swing axis 659 is located slightly further from the front portion 612 than the rear end 692 of the reciprocating path T1 is as shown in FIG. 29. More specifically, the positions of the swing axis 659 can determine incline levels of the reciprocating path Tl. As mentioned before, the path T1 is a reciprocating path including a front end 694, a rear end 692, and a balance position 696. If the swing axis 659 is in the first position, the incline level of the reciprocating path T1 can be defined by an included angle θ1 between the imaginary extending line L extending along the direction from the front end 694 to the rear end 692 and the horizontal line H. In this embodiment, θ1 is 45 degrees. Meanwhile, the moving path of second end portions 620*a*"/620*b*" of the supporting members 620*a*/620*b* is defined as a reciprocating path T3. The reciprocating path T3 includes a front end A5', a rear end A5", and a balance position A5. Besides, an internal limitation curve C1 and an external limitation curve C2 are also disclosed. C1 and C2 are curves having the same center O, the radius of C1 is the difference of the length of supporting member 620 and radius of T2, and the radius of C2 is the sum of the length of supporting member 620 and radius of T2. According to geometrical principle, the second end portions 620*a*"/620*b*" of the supporting members 620*a*/620*b* could only move along the reciprocating path T3 between C1 and C2, and therefore the front end A5' and the rear end A5" are determined.

Figure 33:
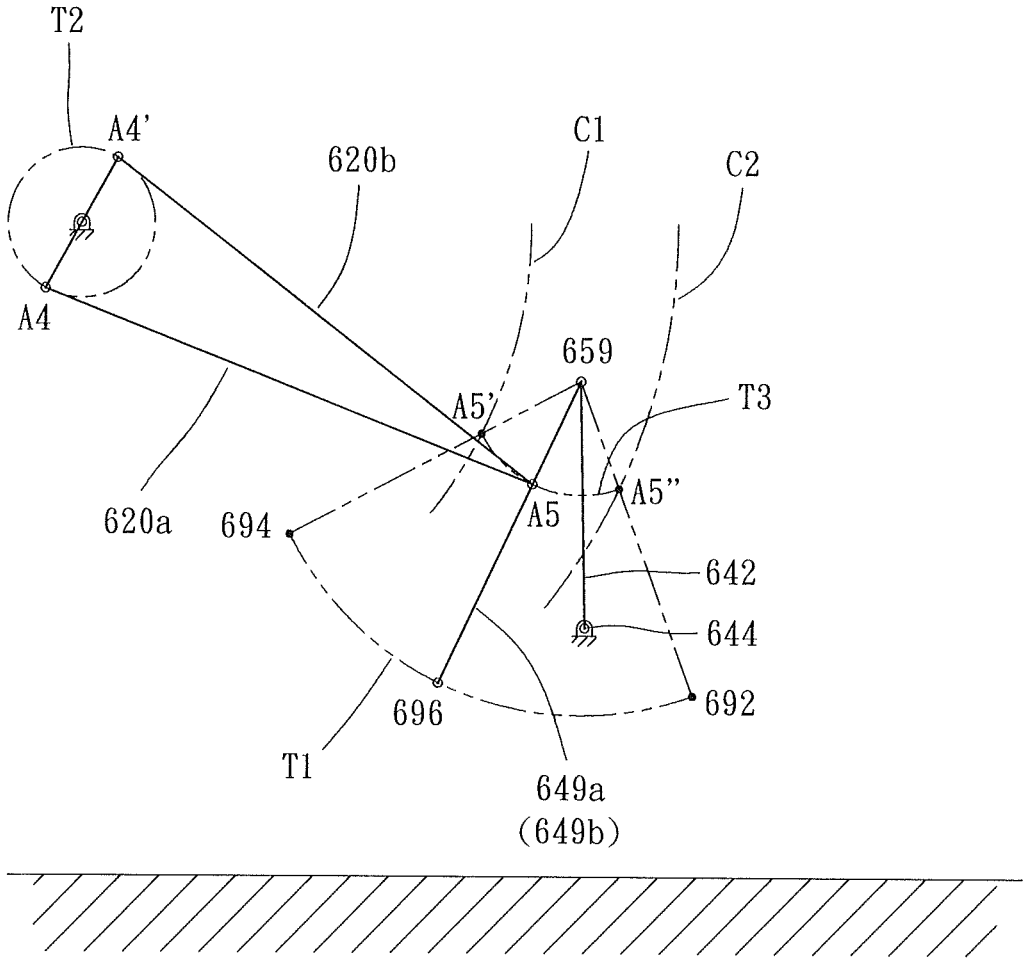
Figure 34:
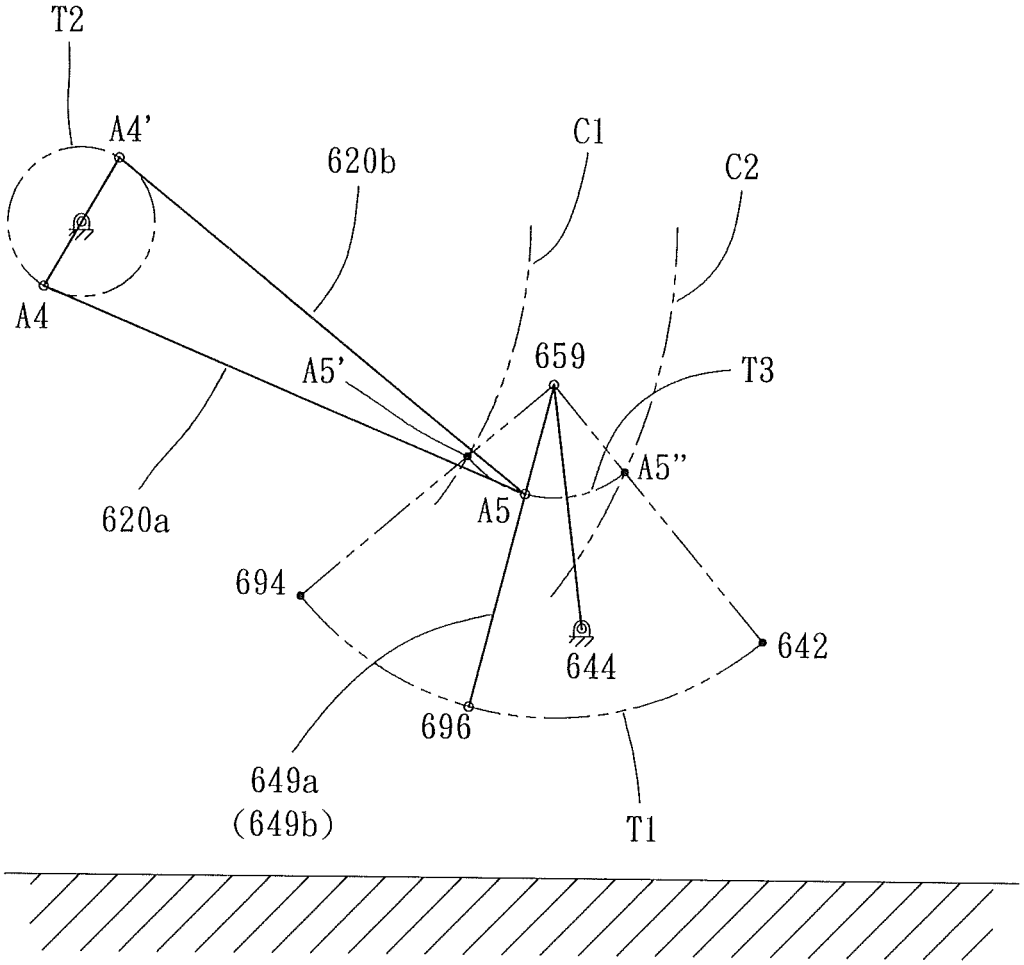

Now referring to FIGS. 33 and 34, FIGS. 33 and 34 respectively show the path information and geometry parameters of the stationary exercise apparatus 600 in a second position and in a third position while the swing axis 659 is located above the second axis 644 as shown in FIG. 30 and the swing axis 659 is located slightly closer to the front portion 612 than the rear end 692 of the reciprocating path T1 is as shown in FIG. 31. If the swing axis 659 is positioned rearward in view of an orientation of an operating user, the incline level of the reciprocating path T1 is increased. A higher incline level of the reciprocating path T1 creates higher exercise intensity of a user. On the other hand, as shown in FIG. 33, the swing axis 659 is positioned closer to the front portion 612 than the rear end 692 of the reciprocating path T1 is so that reciprocating path T1 is less inclined, θ1 is smaller (not shown, 21 degrees), and the exercise intensity is decreased. In order to obtain higher exercise intensity, the swing axis 659 can be re-positioned farther toward the rear. As shown in FIG. 34, the swing axis 659 is positioned further closer to the front position 612, and the reciprocating path T1 is in a relatively low incline level so that a lower incline level is achieved, different exercise pose will be needed, and the user will exercise with different muscles. To conclude, in this embodiment, at least one geometry parameter of reciprocating path T1 could be varied while the swing axis 659 is being adjusted relative to the frame 610. In this embodiment, the geometry parameter of reciprocating path T1 being varied is the incline level.

In one preferred embodiment of the present disclosure, the driving adjusting assembly 640 can be controlled via the console to vary the incline level of the reciprocating path T1 and to adjust the exercise intensity and the exercise pose while using the stationary exercise apparatus 600. As mentioned previously, the upper portions 649*a*"/649*b*" of the swing members 649*a*/649*b* are coupled to the moving assembly 641 of the frame 610. The driving adjusting assembly 640 could be connected between the lateral link (not shown) of the moving assembly 641 and the frame 610. Therefore, a user can electronically actuate the adjusting assembly 640 to vary the position of the swing axis 659 and adjust the incline level of the reciprocating path T1. It should be noted that the (lateral) link could be omitted in some embodiments, not shown in the figures. For example, two driving adjusting assemblies could be directly connected to the first and second moving members 642, respectively. It should also be noticed that the incline level of the stationary exercise apparatus 600 is not limited to an electronically adjustment. Some manual adjustments, such as pin and holes combinations, levers, cranks and the like are also within the scope of the present invention.

Figure 35:
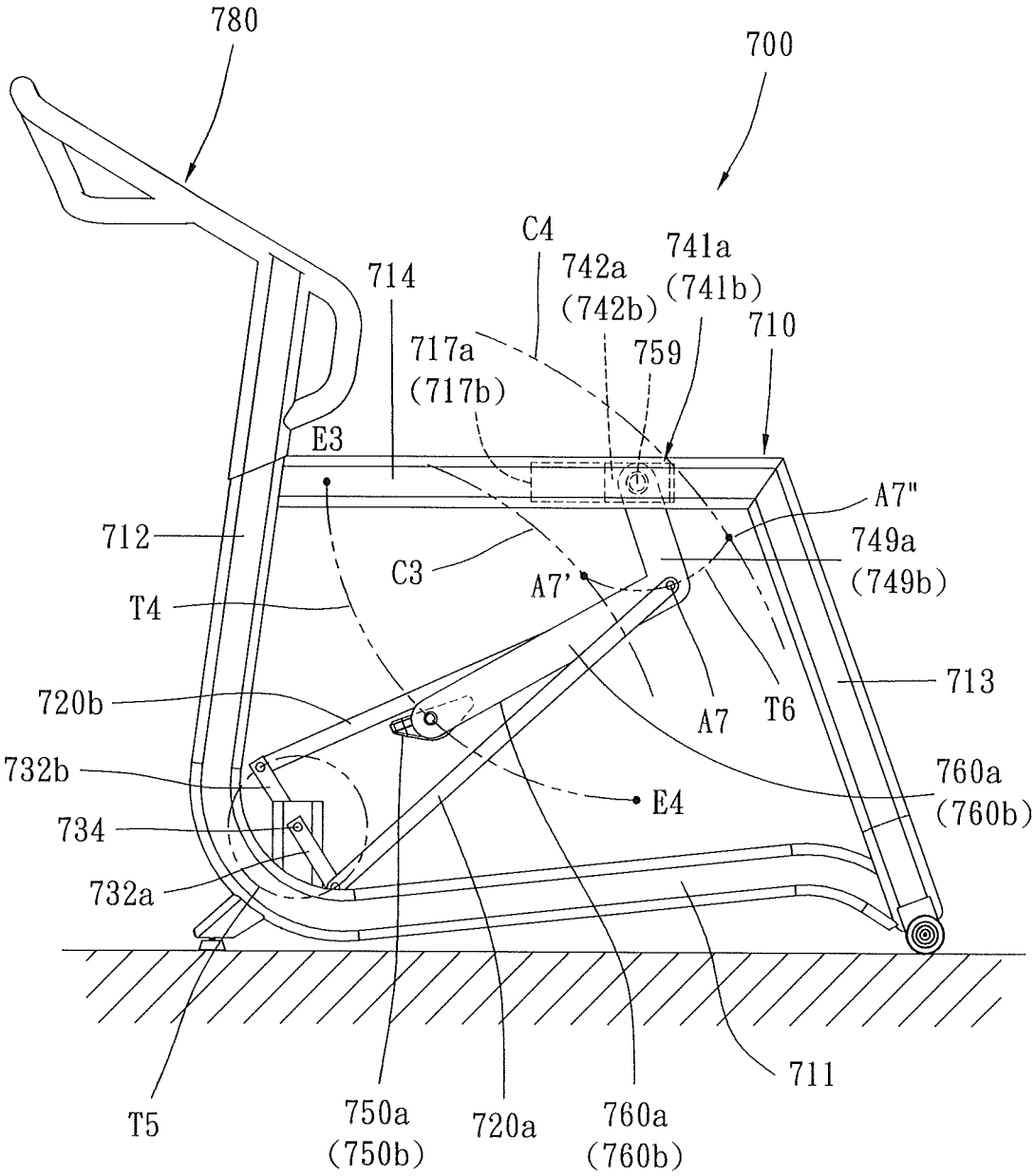
FIGS. 35~37 are perspective side views of a stationary exercise apparatus according to a seventh embodiment of the present disclosure with the swing axis in a first position, in a second position, and in a third position.

Now referring to FIG. 35, a seventh embodiment of the present disclosure in a first position is shown. A stationary exercise apparatus 700 comprises a frame 710 having a base portion 711 adapted to rest on a surface. The frame 710 further comprises a front portion 712 extending upwardly from the base portion 711, a side portion 714 extending longitudinally rearward from the front portion 712, and a rear portion 713 connecting the side portion 714 and the base portion 711. A fixed handle assembly 780 and a console (not shown) could be optionally mounted on or near the upper end of the front portion 712.

The stationary exercise apparatus 700 further has first and second supporting members 720*a*/720*b*, each of the supporting members 720*a*/720*b* having a first end portion and a second end portion. The first end portions of the first and second supporting members 720*a*/720*b* are respectively pivoted to a pair of rotating cranks 732*a*/732*b* in order to rotate about a first axis 734. The second end portions of the first and second supporting members 720 are respectively connected to the lower portions of first and second swing members 749*a*/749*b*. The upper portions of the first and second swing members 749*a*/749*b* are coupled to the side portion 714 of the frame 710 via a swing axis 759. More specifically, the upper portions of the first and second swing members 749*a*/749*b* are pivotally connected to left and right moving assemblies 741*a*/741*b*.

The left and right moving assemblies 741*a*/741*b* respectively comprise third and fourth moving members 742*a*/742*b* and left and right guiding slots 717*a*/717*b*. The moving members 742*a*/742*b* are respectively engaged in the guiding slots 717*a*/717*b* and the position of the swing axis 759 could be adjusted along the guiding slots 717*a*/717*b* accordingly. Although described and illustrated as a slot moving mechanism, the moving assemblies 741*a*/741*b* could be any manual or automatic mechanical, electromechanical, hydraulic, or pneumatic device and be within the scope of the invention.

Similar to the previous embodiment of the stationary exercise apparatus 100, the stationary exercise apparatus 700 also comprises a pair of pedals 750*a*/750*b* respectively coupled to the supporting members 720*a*/720*b*. Optionally, the stationary exercise apparatus 200 also has a pair of control links 760*a*/760*b* respectively pivoted to the supporting members 720 and each of the supporting members 720*a*/720*b* extending along a direction different from the extending direction of the corresponding one of the swing members 749*a*/749*b*. According to geometry, the stationary exercise apparatus 700 includes swing members 749*a*/749*b* rotating about the swing axis 759 with the second end portions of the supporting members 720*a*/720*b* moving along a first reciprocating path T6 and the pedals 750*a*/750*b* moving along a second reciprocating path T4 while the first end portions of the supporting members 720*a*/720*b* rotating about the first axis 734 along a round path T5. The first reciprocating path T6 is located between an internal limitation curve C3 and an external limitation curve C4 and has a front end A7', a rear end A7", and a middle position A7. Therefore, the second reciprocating path T4 has a front end E3 and a rear end E4.

Figure 36:
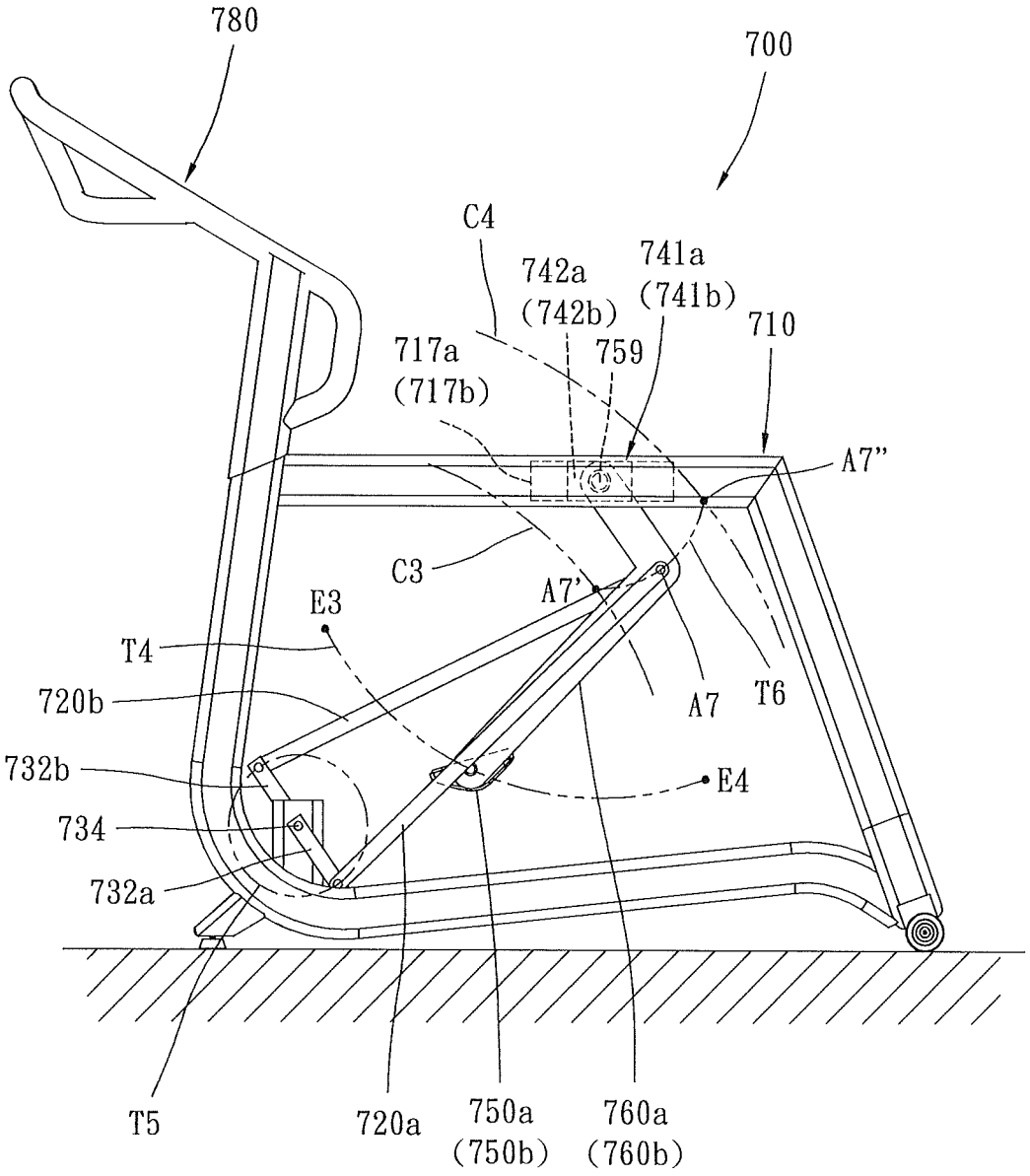
Figure 37:
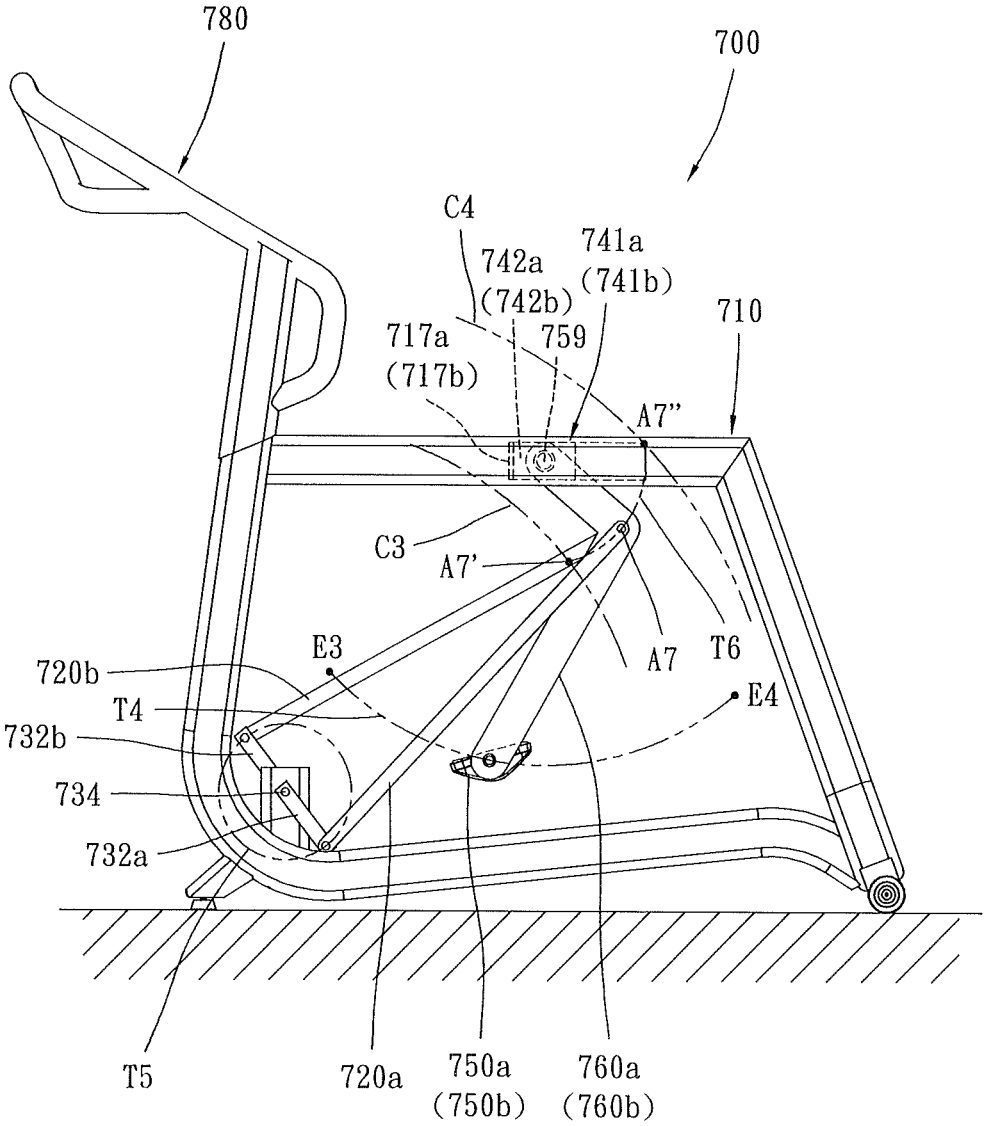

FIGS. 36 and 37 illustrated the same stationary exercise apparatus 700 in the second and third positions, respectively. As the same geometrical principle previous mentioned, when the swing axis 750 is adjusted along the guiding slots 741*a*/741*b* toward closer to the front position 712, the inclined level of the second reciprocating path T4 is lower.

The previously described embodiments of the present disclosure have many advantages, including: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an increased stride length; and (d) to provide a user of the stationary exercise apparatus with a benefit of better gluteus exercise; (e) to provide the stationary exercise apparatus with a more compact and succinct appearance. The present disclosure does not require that all the advantageous features and all the advantages need to be incorporated into every embodiment thereof. Although the present disclosure has been described in considerable detail with reference to certain preferred embodiment thereof, other embodiments are possible. Therefore, the spirit and scope of the appended claims should not be limited to the description of the preferred embodiment contained herein.

What is claimed is:

1. A stationary exercise apparatus, comprising:

a frame;

two moving members, each moving member having a first end portion and a second end portion, the first end portions of the two moving members respectively pivotally coupled to the frame to move the second end portions of the two moving members forward and backward;

two swing members, each swing member having an upper portion and a lower portion, the upper portions of the two swing members respectively pivotally coupled to the second end portions of the moving members about a swing axis;

two supporting members, each supporting member having a first end portion and a second end portion, the first end portions of the two supporting members respectively coupled to the frame to rotate about a rotating axis, the second end portions of the two supporting members respectively coupled to the swing members; and two pedals respectively coupled to the lower portions of the two swing members, the pedals moving along a reciprocating path while the first end portions of the two supporting members are rotating about the rotating axis;

wherein, the swing axis is movable forward or backward when the second end portions of the two moving members is adjusted forward or backward, and the reciprocating path of the two pedals is changed at the same time.

2. The stationary exercise apparatus of claim 1, wherein the reciprocating path is an arc path.

3. The stationary exercise apparatus of claim 1, wherein the reciprocating path having a front end and a rear end, and the swing axis is positioned higher than the front end of the reciprocating path.

4. The stationary exercise apparatus of claim 1, wherein the orientations of the pedals are respectively adjustable relative to the corresponding supporting members.

5. A stationary exercise apparatus, comprising:

a frame having a front;

two supporting members, each supporting member having a first end portion and a second end portion, the first end portions of the supporting members respectively coupled to the frame to rotate along a first path about a first axis;

two swing members, each swing member having an upper portion and a lower portion, the swing members respectively connected to the second end portions of the supporting members;

two pedals respectively coupled to the lower portions of the two swing members, the pedals moving along a second path while the first end portions of the supporting members are rotating about the first axis; and two moving members respectively coupled to the frame and being movable relative to the frame, the Upper portions of the swing members respectively pivotally joined to the moving members about a swing axis such that the upper portions of the swing members and the swing axis are adjustable relative to the frame;

wherein at least one geometry parameter of the second path could be varied while the swing axis is being adjusted relative to the frame.

6. The stationary exercise apparatus of claim 5, wherein the second path is an arc path.

7. The stationary exercise apparatus of claim 5, wherein the second path is a reciprocating path.

8. The stationay exercise apparatus of claim 7, wherein the reciprocating path has a front end and a rear end, and wherein the rear end of the reciprocating path is positioned farther from the front of the frame than the swing axis.

9. The stationary exercise apparatus of claim 7, wherein the reciprocating path has a front end and a rear end, and the swing axis is positioned higher than the front end of the reciprocating path.

10. The stationary exercise apparatus of claim 5, wherein the geometry parameter is an incline level of the second path and the incline level of the second path could be increased while the swing axis is being adjusted rearward relative to the front of the frame.

11. The stationary exercise apparatus of claim 5, wherein orientations of the pedals are respectively adjustable relative to the corresponding swing members.

12. The stationary exercise apparatus of claim 5, wherein the pedals move toward opposite directions relative to a balance position.

* * * * *